US005138343A

United States Patent [19]

Aichi et al.

[11] Patent Number: 5,138,343

[45] Date of Patent: Aug. 11, 1992

[54] INK JET RECORDING APPARATUS WITH RECOVERY MEANS

[75] Inventors: Takao Aichi, Tokyo; Tamaki Hashimoto, Yokohama; Yoji Ara, Yokohama; Shinya Matsui, Yokohama; Takashi Nojima, Tokyo; Hiroyuki Inoue, Chiba; Tetsuo Suzuki; Junichi Asano, both of Kawasaki; Makoto Takemura; Koji Terasawa, both of Tokyo; Katsuyuki Yokoi, Yokohama, all of Japan

[73] Assignee: Canon Kabushiki Kaisha, Tokyo, Japan

[21] Appl. No.: 719,700

[22] Filed: Jun. 26, 1991

Related U.S. Application Data

[63] Continuation of Ser. No. 569,572, Aug. 15, 1990, abandoned, which is a continuation of Ser. No. 418,384, Oct. 6, 1989, abandoned.

[30] Foreign Application Priority Data

| | | | |
|---|---|---|---|
| Oct. 7, 1988 | [JP] | Japan | 63-254206 |
| Oct. 7, 1988 | [JP] | Japan | 63-254207 |
| Oct. 7, 1988 | [JP] | Japan | 63-254217 |
| Oct. 7, 1988 | [JP] | Japan | 63-254225 |
| Dec. 27, 1988 | [JP] | Japan | 63-328024 |

[51] Int. Cl.[5] ..... B41J 2/05; B41J 2/165

[52] U.S. Cl. ..... 346/140 R; 346/134

[58] Field of Search ..... 346/140, 134, 136

[56] References Cited

U.S. PATENT DOCUMENTS

| | | | |
|---|---|---|---|
| 4,144,537 | 3/1979 | Kimura et al. | 346/140 R |
| 4,311,399 | 1/1982 | Wegryn et al. | 400/76 |
| 4,506,277 | 3/1985 | Terasawa | 346/140 |
| 4,734,719 | 3/1988 | Suzuki | 346/140 R |
| 4,739,340 | 4/1988 | Terasawa | 346/1.1 |
| 4,754,961 | 7/1988 | Tokuda et al. | 271/114 |
| 4,825,231 | 4/1989 | Nozaki | 346/140 R |
| 4,847,637 | 7/1989 | Watanabe et al. | 346/140 R |
| 4,893,138 | 1/1990 | Terasawa et al. | 346/140 |

FOREIGN PATENT DOCUMENTS

| | | |
|---|---|---|
| 3723954 | 4/1988 | Fed. Rep. of Germany . |
| 47-030307 | 11/1972 | Japan . |
| 58-082777 | 5/1983 | Japan . |
| 59-033155 | 2/1984 | Japan . |
| 62-263058 | 11/1987 | Japan . |
| 2207661 | 2/1989 | United Kingdom . |

*Primary Examiner*—Joseph W. Hartary

*Attorney, Agent, or Firm*—Fitzpatrick, Cella, Harper & Scinto

[57] ABSTRACT

A recording apparatus effects a recording operation by scanning a recording medium in a predetermined direction with a recording head provided with discharge openings for recording liquid. A cap member is capable of covering a face with discharge openings of said recording head. A transmission member causes said cap member to cover said face with discharge openings in response to a motion setting said recording head to a predetermined position; and engaging members consisting of a protruding part are provided on one of said recording head and a carriage supporting said head. The protruding part engages a receiving part for said protruding part formed on the other of said recording head and said carriage, wherein said protruding part and said receiving part mutually engage at two points when said cap member covers said face with discharge openings.

25 Claims, 25 Drawing Sheets

| FIG. 7A |
| --- |
| FIG. 7B |

| FIG. 27A |
| --- |
| FIG. 27B |

INK JET RECORDING APPARATUS WITH RECOVERY MEANS

This application is a continuation of application Ser. No. 07/569,572, filed Aug. 15, 1990, now abandoned, which in turn is a continuation of application Ser. No. 07/418,384 filed Oct. 6, 1989, now abandoned.

BACKGROUND OF THE INVENTION

1. Field of the Invention

The present invention relates to a liquid emission recording apparatus, and more particularly to a liquid emission recording apparatus (hereinafter called "ink jet recording apparatus") of so-called serial type in which the recording is conducted by moving a recording head, provided with discharge openings for recording liquid (hereinafter called "ink"), in a predetermined direction with respect to a recording medium.

More specifically the present invention relates to an ink jet recording apparatus equipped with capping means for preventing emission failure due to blockage of discharge openings caused by highly viscous ink, solidified ink, dust, bubbles etc., or with an emission recovery or restore device for resolving emission failure of the ink utilizing said capping means.

Also the present invention relates to an ink jet recording apparatus in which the driving source for feeding the recording sheet is utilized also for other purposes, such as for a recovery system for protecting the face of discharge openings of the recording head and for eliminating the ink solidified or viscosified in the discharge openings.

2. Related Background Art

In the conventional ink jet recording apparatus of this kind, the recording elements of the recording head mounted for example on a carriage may cause blocking or clogging in the discharge openings for example resulting from an increase in the ink viscosity due to the evaporation of solvent in the ink, thus resulting in defective recording or ink emission failure. For this reason, when the recording operation is not being conducted, the face of the recording head bearing the discharge openings is covered with a cap.

Among such apparatus, there is known an apparatus equipped with a mechanism for effecting the capping operation in relation to the movement of a carriage, supporting the recording head, to a predetermined position (for example home position). Such structure is advantageous in simplifying the construction of the apparatus, and reducing the manufacturing and running cost of the apparatus, since the movement of the capping member does not require a particular driving source such as a motor.

In such structure, the capping operation is forcedly conducted after the lapse of a predetermined time or upon detection that the recording head is out of a certain position, in order to prevent the drying of the recording elements in the stand-by state after recording. In such case the carriage motor for driving the carriage is driven with a low current.

However, thereafter a disabled recording start may occur due to the disrupted balance of surface tension of the ink in the vicinity of the discharge openings, caused by temperature increase in the recording elements in the capped state or by increase in the saturated vapor pressure of the ink in the capped space. For this reason, the space enclosed by the cap is made to communicate with the exterior after the lapse of a predetermined time. Thereafter, the holding of the phases of the carriage motor is interrupted, in order to prevent temperature increase thereof.

There is also known a structure in which, if an instruction for the recovery operation is entered from a data input unit within a predetermined time after the capping operation is started, a sheet feeding motor which is also used for recovery operation is reversed to suck the ink from the vicinity of the discharge openings thereby effecting the recovery operation.

However, in such conventional structure in which the exterior communicating operation and the recovery operation are started independently, the carriage motor may not be in the hold state if the communicating operation is conducted prior to the instruction for recovery operation from the data input unit. For this reason, the carriage may be out of the home position where recovery operation is conducted in proper manner, so that the recovery operation may not be achieved in proper manner after the communicating operation.

Also in the above-explained structures, the capping mechanism functions in response to the engagement of a part of the carriage and a part of the capping member, and a biasing force is applied in order to maintain the carriage in the capped state. It may however be difficult to securely maintain the capped state for example due to eventual play in the component parts.

As explained above, the ink jet recording apparatus utilizes ink as a medium, and effects recording by discharging ink from discharge openings of a recording head onto a recording medium such as paper or overhead projector sheet. However, if non-recording state continues, evaporation of the solvent component of the ink from the discharge openings induces an increase in the ink viscosity or eventual solidification of the ink, so that the ink emission may become difficult or impossible when the recording signals are entered.

A recovery system is therefore provided in order to eliminate the highly viscous or solidified ink in the discharge openings and to prevent the above-mentioned drawbacks. Said recovery can be achieved, for example, by fitting a capping member on the head face having the discharge openings and generating a negative pressure by a pump connected to said capping member. This action forcibly sucking the ink from said discharge openings and thus eliminating the solidified layer of ink.

This method is effective when the solidified layer of ink is thin. However, if the non-recording state continues for a considerably long time, said solidified layer becomes thick and exceeds a limit removable with the negative pressure of the pump, so that the recovery may become impossible. For this reason there is proposed a method called "major recovery". On the other hand, the above-mentioned method is called "minor recovery". The major recovery is conducted by filling a closed space formed by the head face having the discharge openings and the cap member with ink, then leaving the entire system for a suitable period for softening the solidified layer of the ink, and effecting suction operation in this state thereby removing the solidified layer of the ink.

In this major recovery operation, said closed space is filled with fresh ink directly supplied from an ink supply source such as an ink cartridge. For this purpose there are provided a tube for ink supply from the ink cartridge to the capping member, and switch means such as a valve for enabling ink supply through said tube only in the major recovery operation. The minor and major recoveries are switched by the open/closing operation of said valve. Said open/closing operation of the valve has been conducted by a solenoid valve, a motor-driven cam, or by the movement of a carriage supporting the recording head particularly in case of a serial ink jet recording apparatus.

However, the use of a solenoid valve for the above-mentioned switching operation results in an increased cost because the solenoid valve is expensive. Also the use of a motor-driven cam not only results in an increased cost due to the presence of a motor but also may reduce the throughput of the recording operation, since the operating speed is lowered.

On the other hand, the valve operation by the carriage movement is relatively effective since the operating speed is high and there are required few components leading to cost increase. However, there is required a transmission mechanism, such as a lever for valve operation, so that it is difficult to reduces the size of the recovery unit, or the entire ink jet recording apparatus.

Also for removing the highly viscous or solidified ink from the discharge openings of the ink jet recording head, there is known a method of covering the head face having discharge openings with an elastic cap, and sucking ink from the discharge openings by a negative pressure generated by a pump communicating with said cap, thereby eliminating the defective emission. Said pump may be driven by an exclusive motor for the recovery system, but is usually driven by a motor for feeding the recording sheet, for the purpose of both size and cost reduction of the apparatus.

For this purpose, at an end of a roller for feeding the recording sheet, there is provided a spring clutch for transmitting the driving force in the reverse rotation opposite to the rotation for sheet feeding, so that the motor effects sheet feeding in the forward rotation and drives the pump of the recovery system in the reverse rotation.

Said sheet-feeding motor also serves to drive a separating roller for sheet feeding, and is provided with a one-directional spring clutch in the transmission to said separating roller. The transmission of the driving force is turned off when a finger member engages with a part of said spring clutch, and is turned on when said finger member disengages. The sheet feeding operation is started by disengaging said finger member with a plunger or a carriage supporting the recording head, and is terminated when the spring clutch engages with said finger member again after the rotation of the separating roller.

In such conventional structure, when the sheet-feeding roller is reversed for activating the pump, the sheet-feeding spring clutch is supposed to slip and remain in the engaging position with the finger member. In practice, however, said spring clutch may also be reversed together with the roller and become unable to retain the initial state of sheet feeding engaged with the finger member, for example due to an increased slipping torque resulting from fluctuation in the manufacture of the spring clutch or a fluctuation in the load torque of the entire sheet feeding unit.

Consequently, when the finger member is disengaged by the plunger or the carriage at the sheet feeding operation, the sheet feeding operation is terminated before the separating roller reaches the normal rotational position. This may result in defective sheet feeding, or, in worst case, a situation where the sheet feeding is impossible.

As already explained above, in an ink jet printer for effecting the recording operation by flying ink droplets from discharge openings of the recording head according to recording data, there is provided an emission recovery mechanism for supplying ink to the discharge openings under pressure or sucking the ink from said discharge openings, in order to prevent ink solidification or dust deposition in the vicinity of the discharge openings.

FIG. 1 is a schematic perspective view of an ink jet printer provided with a conventional recovery or restore unit. In FIG. 1, a recording head 101 provided with plural ink discharge openings is mounted on a carriage 102, which is guided by a pair of guide rails 103 fixed on side plates (not shown) and is moved in a direction A by a wire 104 driven by a drive source (not shown). Rollers 106, 108 serve to transport a recording medium 107. An emission recovery unit 105 is equipped with a cap 116 movable in a direction B (B' or B'') by means of a drive source (not shown), and effects ink suction in a state in which said cap 116 is fitted on the head 101.

In the emission recovery operation, the carriage 102 starts to move from a position in the recording area, for effecting the recording operation on the recording medium 107, to the illustrated position. In this state the cap 116 is retracted in a direction B' and housed in the emission recovery unit 105. After the carriage 102 is stopped at the illustrated position, the cap 116 is moved in a direction B'' for example by a motor and contacts front end portion 101A of the recording head 101. The cap 116 is composed of a flexible material, and seals the ink discharge openings at the front end portion 101A of the recording head 101 from the exterior. When the emission recovery unit 105 generates a negative pressure in this state, the ink is sucked out from the recording head 101, thereby eliminating the cause of emission failure such as clogging of the discharge openings.

In such conventional structure, however, the pressure of the cap 116 is totally received by the front end portion 101A of the recording head, so that the recording head 101 or the cap 116 may be deformed by the repeated capping operation, thus becoming unable to maintain the sealed state and deteriorating the sucking effect. Also it may become difficult to maintain an appropriate distance (0.3-20 mm) between openings and the recording surface at the recording operation, if a strong pressure is applied to the recording head.

Consequently, in order to achieve the complete sealing by withstanding the pressure at the capping operation, it is necessary to increase the rigidity of the carriage 102 and the guide rail 103, and the supporting rigidity between the recording head 101 and the carriage 102. These components have to be made larger particularly in a color recording apparatus employing plural recording heads 101 according to the number of colors, and an increase in the dimension of the apparatus and an increase in the cost thereof are unavoidable.

SUMMARY OF THE INVENTION

An object of the present invention is to prevent such various drawbacks and to effect normal recovery operation, thereby maintaining the stability of the recording elements.

Another object of the present invention is to effect, particularly in a serial ink jet recording apparatus, the above-mentioned switching operation in relation to the movement of the carriage, thereby increasing the operation speed without increase in cost, and to provide an appropriate transmission mechanism for contributing to the compactness of the apparatus.

Another object of the present invention is to provide an ink jet recording apparatus capable of securely maintaining the capped state even in the presence of play in the component parts.

Still another object of the present invention is to minimize the number of components of increased rigidity required for maintaining the sealed state, thereby preventing increase in the dimension or in the cost of the apparatus even when the number of recording heads is increased.

Still another object of the present invention is to provide an ink jet recording apparatus in which, if the sheet-feeding motor is reversed for the emission recovery operation, said motor is rotated by a predetermined amount in the forward direction, thereby always maintaining the initial state in the sheet feeding operation.

The present invention provides the recording apparatus for effecting recording operation by scanning a recording medium in a predetermined direction with a recording head provided with discharge openings for recording liquid, comprising a cap member capable of covering a face with discharge openings of said recording head; a transmission member having a mechanism for causing said cap member to cover said face with discharge openings in relation to a setting motion of said recording head to a predetermined position; recovery means for effecting an emission recovery process by forcedly causing discharge of said recording liquid from said discharge openings at said predetermined position; first control means for controlling drive means for said scanning motion in such a manner that said recording head is locked in said predetermined position; open/-closing means for opening and closing the space closed by said cap member to the exterior when the state of capping of said face with discharge openings by said cap member is continued for a predetermined time; second control means for terminating the function of said drive means after said open/closing; and third control means for resetting said recording head at said predetermined position, prior to the activation of said recovery means after said open/closing.

The present invention also provide the recording apparatus for effecting recording operation by scanning a recording medium in a predetermined direction with a recording head provided with discharge openings for recording liquid, comprising setting means for setting said recording head at a first position outside a scanning range for said recording and a second position more distant from said range; a cap member capable of covering a face with discharge openings of said recording head and provided, in a part thereof, with an externally communicating unit; a transmission mechanism supporting said cap member and adapted to cause said cap member to cover said face with discharge openings at least in a range from said first to second position, in relation to the setting motion to said first position from said scanning area for recording; pressure generating means for applying a negative pressure in a space defined by said face with discharge openings and by said cap member covering said face, or applying a pressure for introducing ink from an ink source into said space; valve means for switching a fluid path either in a first direction for applying the negative pressure in said space or in a second direction for applying said pressure for said ink introduction; and a closing member adapted for closing said externally communicating unit of said cap member at said first position and moving with said recording head to said second position while maintaining said closed state, and for biasing a valve member of said valve means in a position for switching the fluid path to said second direction in response to the motion to said second position.

The present invention also provides the recording apparatus for effecting recording operation by scanning a recording medium in a predetermined direction with a recording head provided with discharge openings for recording liquid, comprising a cap member capable of covering a face with discharge openings of said recording head; a transmission member for causing said cap member to cover said face with discharge openings in relation to a setting motion of said recording head to a predetermined position; and engaging members consisting of a protruding part provided on one of said recording head and a carriage supporting said head, and a receiving part for said protruding part formed on the other of said recording head and said carriage, wherein said protruding part and said receiving part mutually engage at two points when said cap member covers said face with discharge openings.

The present invention also provides the recording apparatus comprising a recording head with discharge openings for recording liquid; capping means comprising a cap member positioned opposite to said recording head and adapted to move relative to said recording head in said opposed position thereby covering a face, with discharge openings, of said recording head; and engaging means consisting of engaging parts respectively provided on said recording head or support means supporting said recording head and said capping means and adapted to mutually engage in said opposed state thereby prohibiting the movement of said recording head in the direction of said relative movement in said mutually engaging state.

According to the present invention, when the recovery operation is conducted after the opening and closing operations to the exterior of the space closed by the capping, the recording head is set again at the predetermined position. As the capping is conducted thereafter, the recovery operation is started in a securely capped state. Therefore, when the capping is continued for a predetermined period, there can be prevented a situation of disabled recovery arising from the improper positioning of the recording head, even if the power supply to the motor is interrupted for avoiding the heat generation in the stand-by state for recording.

Also according to the present invention, the closing member for opening/closing the externally communicating unit of the cap member can be composed of a member, such as a lever, for moving the valve member of the valve mean (major recovery valve). The major recovery valve can then be opened or closed by the position of said closing member to select the minor recovery or large restore by suction with the negative pressure or the major recovery or small restore by introduction of liquid to the face with discharge openings.

Furthermore, according to the present invention, since the protruding part and the receiving part mutually engage at two points in the capped state, the recording head and the cap member are securely fixed in comparison with the case of mutual contact by face, even if a positional aberration exists due to the precision of the components.

Furthermore, according to the present invention, engaging means is provided in a position where the recording head or the support means therefor and the capping means mutually overlap, and serves to support the force generated between the recording head and the cap member, so that secure closing can be achieved with a minimum number of the components of high rigidity.

Furthermore, according to the present invention, after performing the predetermined functions for example of the emission recovery device which is also driven by the sheet feeding motor, the clutch is maintained in the initial state of sheet feeding operation by the rotation of said motor.

According to the present invention, as explained in the foregoing, in an ink jet recording apparatus equipped with a mechanism for capping a face of the recording head in relation to the motion of said recording head or the carriage supporting said recording head, recovery means for forcedly discharging ink from the recording head in said capped state, means for opening and closing the space formed by said capping to the exterior when the capped state continues for a predetermined period, and means for terminating the power supply to the motor for moving the recording head after said opening and closing operation, the capping operation is always conducted prior to the start of the recovery means after said opening and closing operation, whereby the secure recovery operation is ensured, and the stable state of the recording elements can be maintained.

Also according to the present invention, there can be obtained a compact and highly reliable ink jet recording apparatus, particularly of serial type, with a low cost and an improved operating speed, by utilizing the motion of the recording head or the carriage and utilizing a stopper for controlling the externally communicating hole of the cap in relation to the carriage motion, for directly driving a lever for controlling the major recovery valve for ink supply to the cap.

Furthermore, according to the present invention, the capped state can be securely maintained even when the precision of the components is insufficient, and the sliding resistance is reduced, in comparison with the face-to-face contact, as the contact is made in two points For this reason it is possible to reduce the load of the carriage motor, thus contributing to the compactness and cost reduction of the apparatus.

Furthermore, according to the present invention, an engaging unit is provided at the mutually opposed position of the recording head and the capping means and serves to support the force generated between the carriage for the recording head and the capping means, thereby minimizing the number of components of increased rigidity or precision regardless of the number of recording heads and realizing secure closing. Thus highly reliable recovery process is made possible.

Furthermore, according to the present invention, after a predetermined operation for example of the emission recovery unit which is also driven by the sheet feeding motor, the clutch is maintained, by the rotation of said motor, at the initial state of sheet feeding operation.

This structure avoids the errors in the sheet feeding, and an inexpensive clutch may be used in the sheet feeding as a high precision is not required. Also stable sheet feeding is made possible even if the load in the sheet feeding unit fluctuates.

DETAILED DESCRIPTION OF THE PREFERRED EMBODIMENTS

Now the present invention will be clarified in detail with reference to the attached drawings.

EMBODIMENT 1

Figure 1:
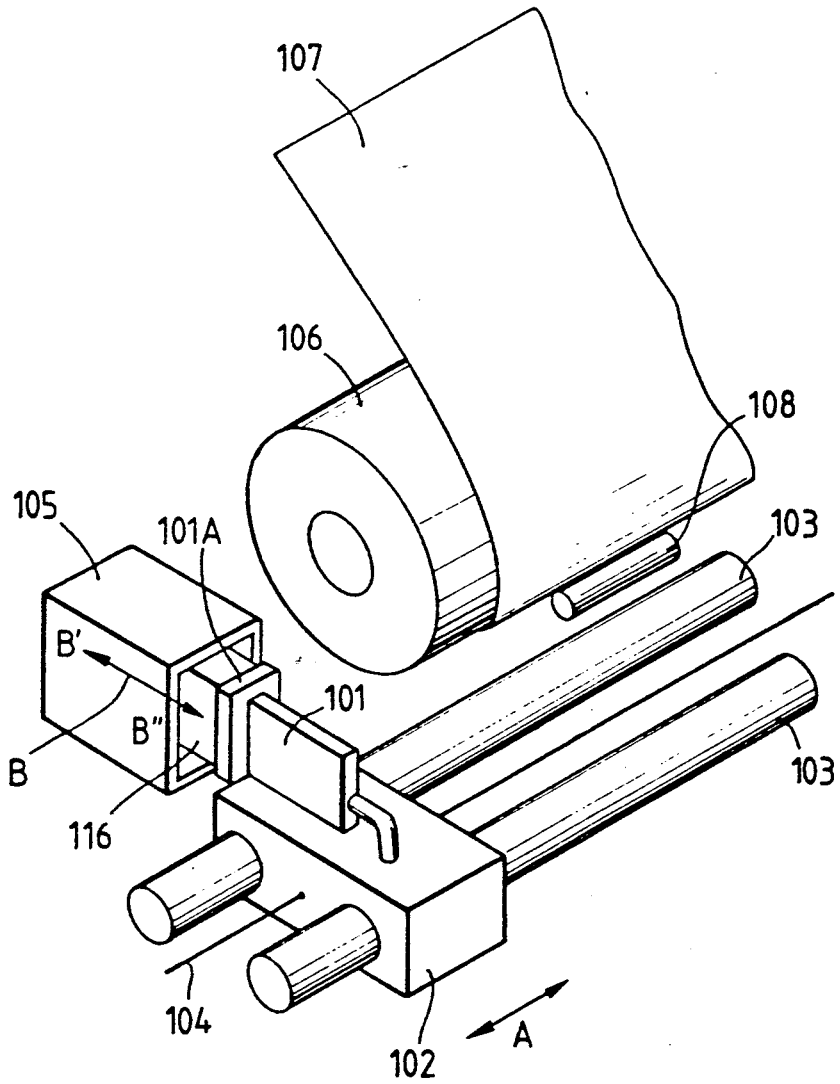
FIG. 1 PRIOR ART
FIG. 1 is a perspective view of a part of a conventional ink jet printer.
Figure 2:
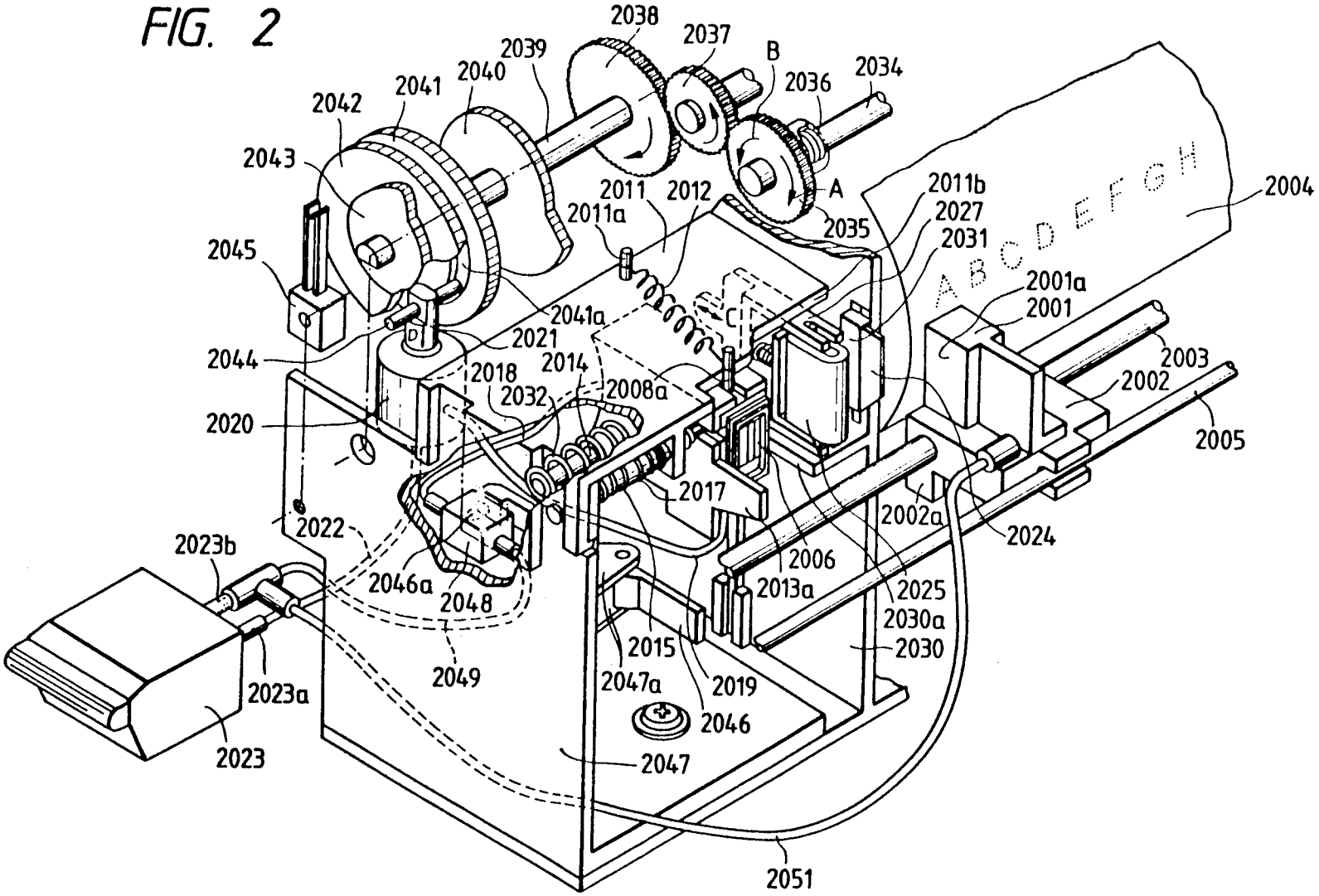
FIG. 2 is a perspective view of a principal part of an embodiment of the ink jet recording apparatus of the present invention.
Figure 3:
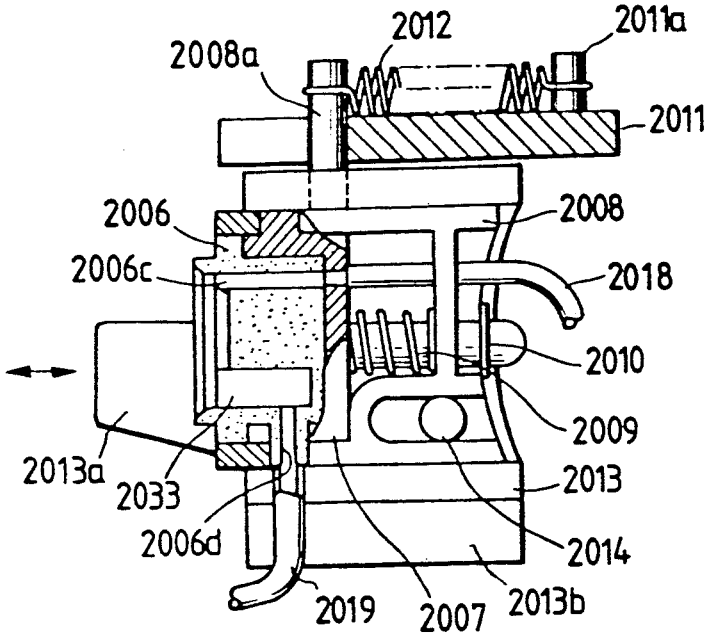
FIGS. 3, 4 and 5 are respectively a lateral cross-sectional view, a front view and a schematic view of a cap portion provided in the recovery means shown in FIG. 2.
Figure 4:
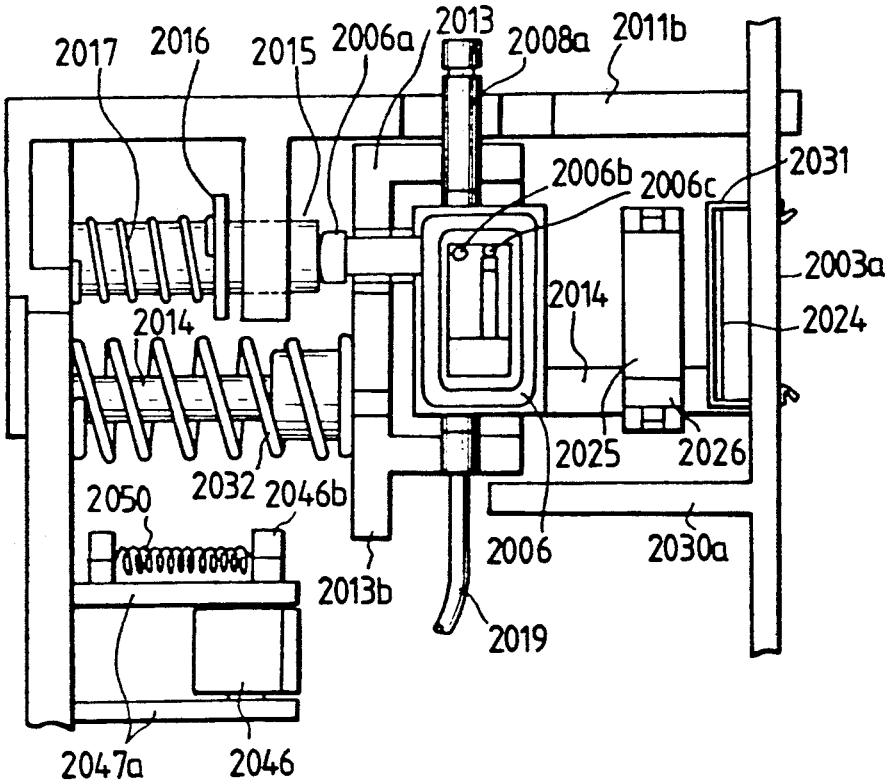
Figure 5:
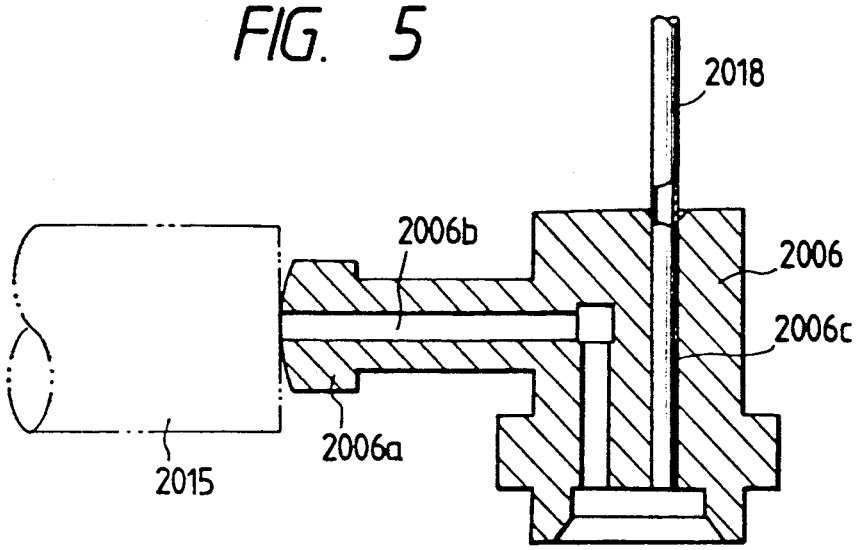
Figure 6:
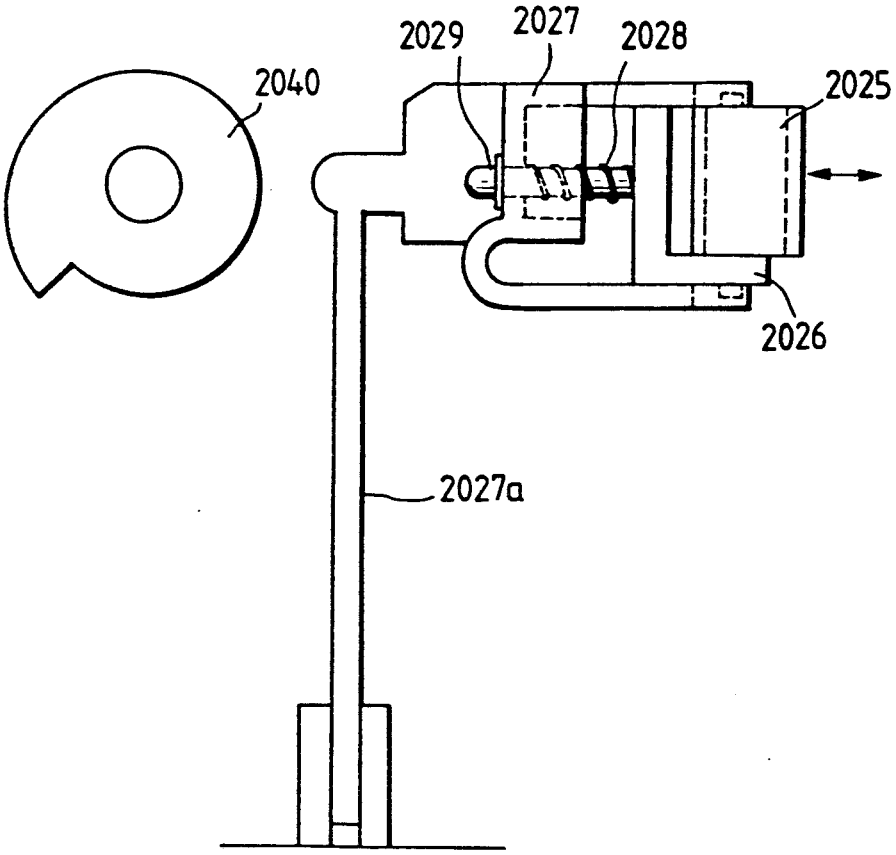
FIG. 6 is a lateral view of a rubbing unit.

FIG. 2 is a view of the principal part of an ink jet recording apparatus constituting an embodiment of the present invention; FIGS. 3 and 4 are respectively a lateral cross-sectional view and an elevation view of a capping unit provided in an emission or discharge recovery mechanism shown in FIG. 2; FIG. 5 is a schematic view of the capping unit; and FIG. 6 is a lateral view of a rubbing unit provided in the emission recovery mechanism shown in FIG. 2. The mechanical structure of the present embodiment will be explained with reference to these drawings.

An ink jet recording head 2001 (hereinafter simply called "recording head" or "head") forms recording ink droplets by means of thermal energy. A carriage 2002, on which the head 2001 is fixed, is moved laterally by a timing belt integral with the carriage 2002, through the function of carriage motor, (not shown) and recording is made on a recording medium 2004 in the course of said movement. An auxiliary shaft 2005 is provided for preventing the carriage 2002 from rotation.

A recovery system is provided for stabilizing the ink droplet emission from the emission openings of the head 2001. When the head 2001 does not effect the recording for a predetermined period (5 seconds in the present embodiment), a face, on which the emission openings are formed, of the head 2001 is closed with a cap 2006 in order to prevent emission failure resulting from the ink solidification in the openings.

FIG. 3 shows a mechanism of closing system including said cap 2006. The cap 2006 is supported by a cap holder 2007 which is in turn supported by a holder 2008. A spring 2009 is provided between the cap holder 2007 and the holder 2008 and is maintained in place by an E-ring 2010 (FIG. 3) in order to provide a suitable pressure at the contact with the head 2001. A spring 2012 (FIG. 3) is provided between a pin 2008*a* of the holder 2008 and a pin 2011*a* of a flat cam 2011. The cap holder 2007 and the holder 2008 are movable in lateral direction in FIG. 3, and a slider 2013 is movable perpendicularly to the plane of drawing.

The slider 2013 supports the cap 2006, cap holder 2007 and holder 2008, and is movable, together with the carriage 2002, along a capping shaft 2014 toward left in FIGS. 2 and 4. In this movement, the pin 2008*a* of the holder 2008 moves along a cam face 2011*b* (FIGS. 2 and 4) of the flat cam 2011, so that the holder 2008 is pressed toward front, namely toward the face of emission openings of the head 2001. The contact pressure in this case is about 300 g. In said contact state, an air valve composed of a pin of the cap 2006 comes into contact with a stopper 2015, as shown in FIGS. 4 and 5. Said stopper 2015 is supported by an E-ring 2016 and a spring 2017 with a contact pressure of about 120 g.

In this state, as shown in FIG. 5, the air valve 2006*a* is closed by the stopper 2015, so that a hole communicating with the air is closed. On the other hand, a major recovery tube 2018 is closed as will be explained later, and a large recovery hole 2006*c* is also closed.

Referring to FIG. 2, a used ink tube 2019 is connected to a pump 2020, in which a negative pressure is generated when a piston 2021 is moved downwards D. Thus a negative pressure is also generated in the cap 2006 in pressure contact with the head 2001, whereby the ink is forcedly sucked through the emission openings of the head 2001, together with the dust and sedimented ink in said emission openings, into the cap 2006, thus resolving the emission failure of the head 2001. During the ascent of the piston 2021 from the lower dead point to the upper dead point, the interior of the pump 2020 is pressurized, whereby the ink sucked from the cap 2006 is discharged as used ink to a used ink reservoir of an ink cartridge 2023 through a used ink tube 2022 and a used ink intake 2023*a*. There is no change in the pressure in the cap 2006 at the discharge of the used ink, due to the pump structure.

In such state, the ink sucked from the openings of the head 2001 still remains in the cap 2006 and the used ink cap tube 2019, so that ink sticks on the face of emission openings of the head 2001. If surface tension of thus sticking ink is larger than the ink emitting force, there will result an emission failure of the ink and a smearing of the recording medium 2004 by ink scattering at the contact of a blade 2024 to be explained later, thus resulting in a significant deterioration of the image quality.

Figures 7, 7A:
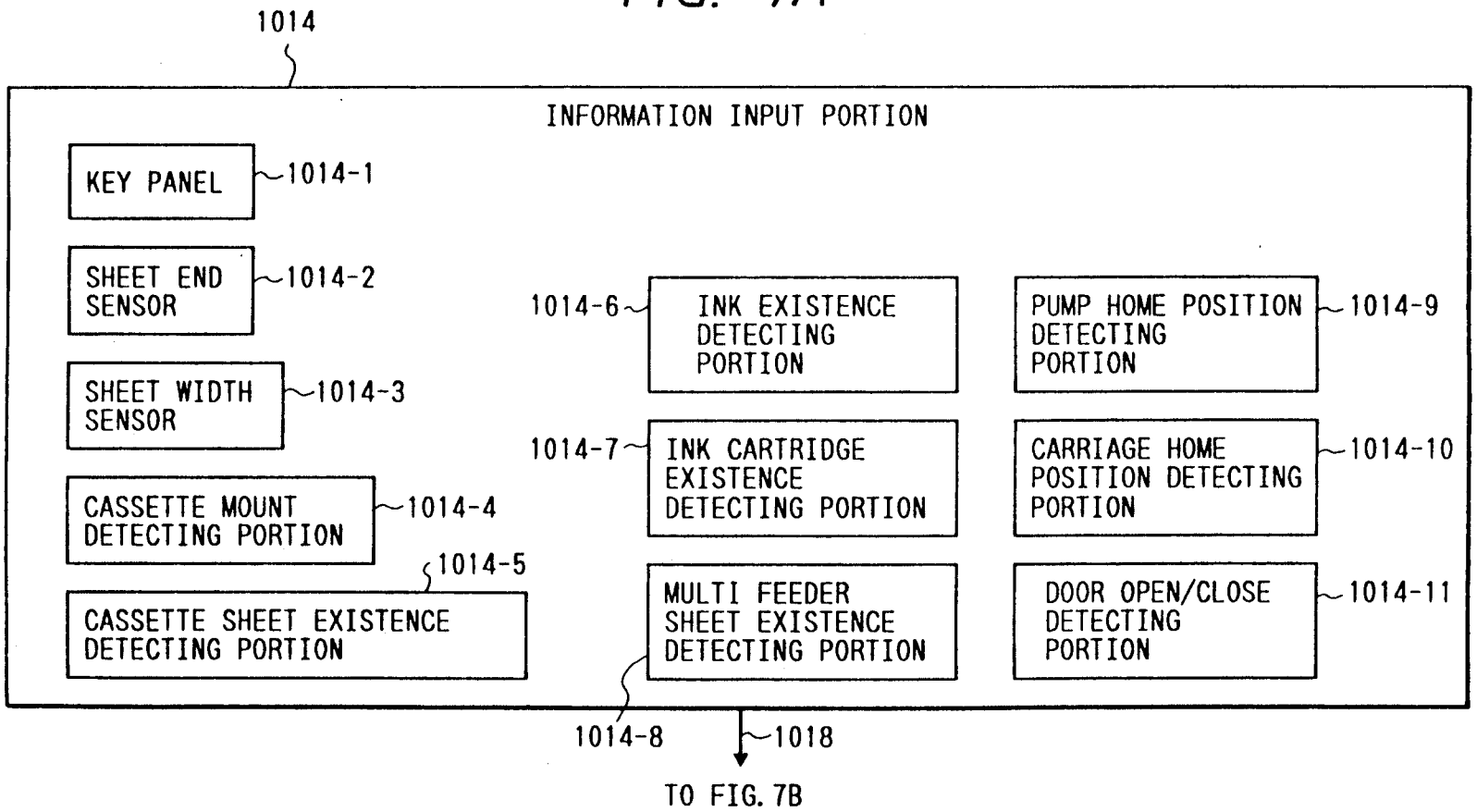
FIG. 7 is a block diagram of an example of a control system corresponding to FIG. 2.
Figure 7B:
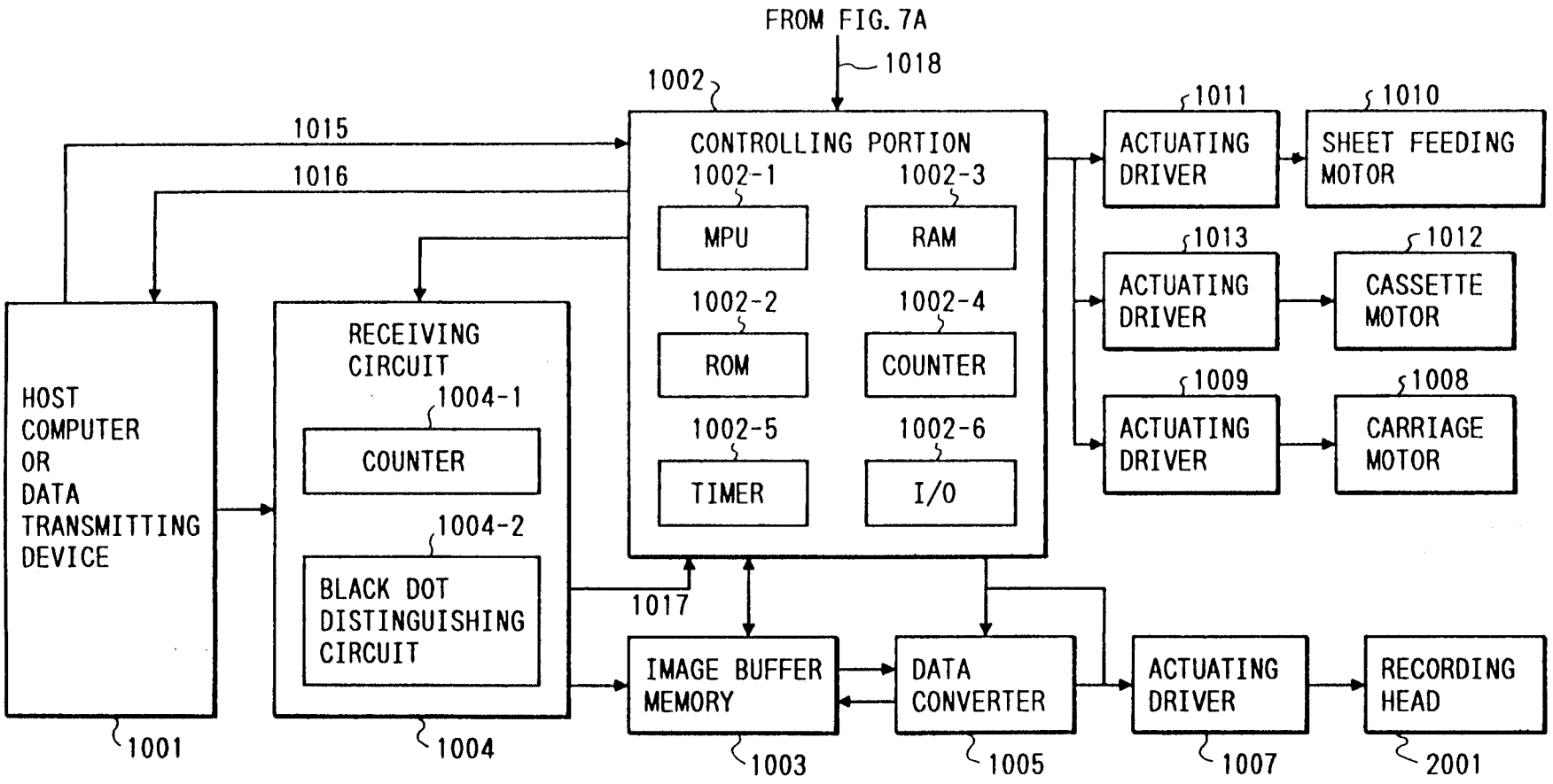

In order to eliminate the ink sticking to the face of emission openings of the head 2001 retained in the cap 2006, for the purpose of avoiding such problem, the carriage 2002 is slightly moved to right (2 mm in the present embodiment) so as to disengage the air valve 2006*a* of the cap 2006 from the stopper 2015, while the cap 2006 is maintained in contact with the head 2001, and the pump unit is activated in this state. Since the communicating hole 2006*b* is L-shaped as shown in FIG. 5 and is positioned in the upper portion of the cap 2006 as shown in FIG. 7, air is sucked into the cap through said hole. As air flows from the upper side of the cap 2006 to the lower side thereof where the used ink cap tube 2019 is mounted, the ink present in the cap 2006 and on the above-mentioned face thereof is eliminated. Subsequently a rubbing member 2025 is advanced as will be explained later, thereby giving a rubbing motion on the face of the head 2001 at the movement of the carriage 2002 from left to right, thus removing the ink and smear from said face and ensuring stable emission of the head 2001.

FIG. 6 shows said rubbing mechanism. An annular rubbing member 2025 is inserted on a cylindrical rubbing holder 2026 which is supported by a rubbing slider 2027 by means of a spring 2028 and an E-ring 2029, whereby the rubbing member 2025 is horizontally movable and rubs the face of the head 2001 with a suitable contact pressure (about 100 g in the present embodiment). The advancing motion of the rubbing slider 2027 is achieved by a cam to be explained later, and the returning motion is achieved by recovering force of an elastic deformation of a part 2027*a* (FIG. 6) of the rubbing slider 2027. Said rubbing member 2025 is composed for example of etheric polyurethane continuous pore foam.

For further stabilizing the emission of the head 2001, or other powder dust deposited in the emission openings during the recording operation are eliminated by wiping with a blade 2024 (FIGS. 2 and 4). In the present embodiment, said blade is composed of flexible silicone rubber of a thickness of about 0.3 mm. Said blade 2024 is fixed on a side plate 2020 of the apparatus by a blade support member 2031 and is always maintained in a protruding position, so that the wiping operation with the blade 2024 is conducted whenever the head moves in front thereof.

During the recording operation, the slider 2013 is returned toward the side plate (right) by a slider return spring 2032, and the cap 2006 is provided at a position defined by the impingement of a part 2013*b* of the slider 2013 with the end portion of a part 2030*a* of the side plate. Also during the recording operation, for preventing the clogging of the unused emission openings of the head 2001, said head 2001 is returned to the waiting position of the cap 2006, and all the nozzles are activated to effect idle emission at a regular interval. Also in this operation, the wiping operation with the blade 2024 is conducted at each reciprocating motion of the head 2001. Also the wiping with the blade 2024 is conducted naturally in relation to the major recovery operation and the recovery operation by above-mentioned suction.

In the idle emission, the pin 2008*a* of the holder 2008 is in contact with a lowered portion of the cam face 2011*b* of the flat cam 2011, whereby the cap 2006 is separated from the head 2001. The ink emitted in the idle emission is absorbed in a polymer absorbent member 2033 in the cap 2006, and is sucked to the pump 2020 at the function thereof. Also a part 2001*a* of the head 2001 is in contact with an arm 2013*a* of the slider 2013, and, at the leftward movement of the carriage 2002, the pin 2008*a* of the holder 2008 climbs the slope of the cam face 2011*b* of the flat cam 2011, whereby the cap 2006 is brought into pressure contact with the head 2001, thus achieving the capping operation.

In the following there will be explained the cam operation. A sheet feeding motor (not shown) performs sheet feeding in the forward rotation. In the reverse rotation, a sheet feeding roller shaft 2034 and a recovery system driving gear 2035 rotate integrally in a direction A by means of a clutch spring 2036 to rotate a cam gear 2038 through an idler gear 2037, whereby a rubbing cam 2040, pump cams 2041, 2042 and a home position cam 2043 are rotated by a cam shaft 2039 integral with the cam gear 2038. On the mutually opposed faces of the pump cams 2041, 2042 there are provided with grooves for guiding the ends of a parallel pin 2044 integrally connected to the piston 2021 of the pump 2020. The rotation of the pump cams 2040, 2041, that is, the positive motion cam moves the piston in a direction D, by the sliding motion of the parallel pin 2044. At the start of power supply, the driving gear 2035 rotates the home position cam 2043, thereby turning on a home position cam 2045 and initializing the cams.

The above-explained recovery operation by suction is called minor recovery and is conducted when the emission failure is easily solvable. On the other hand, a major recovery operation is conducted when the emission failure is not easily solvable, for example by firm ink adhesion to the emission openings of the head 2001. In said major recovery operation, the head 2001 is placed 2 mm to left, in FIGS. 2 and 4, of the position of the minor recovery, while the air valve 2006*a* of the cap 2006 is in contact with stopper 2013 whereby the communicating hole is closed.

The mechanism for major recovery is explained with reference to FIGS. 2 and 4. In a part 2011*b* of the flat cam 2011, the slider 2013 can be smoothly movable in the moving direction of the carriage 2002, and can engage with a part 2046*b* of a lever 2046 in a portion 2013*b* of said slider 2013. The lever 2046 is rotatably supported at the middle by a support member 2047*a*. A major recovery valve 2048 is provided in the vicinity of the other end of said lever 2046, and is actuated by a boss 2046*a* provided on said lever 2046. A spring 2050 is provided for returning the lever 2046 after the slider is moved leftward.

When the carriage 2002 is moved by 2 mm leftward for the major recovery operation, from the position of the minor recovery position, the portion 2013*b* of the slider 2013 engages with the lever portion 2046*b*, whereby the lever 2046 rotates against the biasing force of the spring 2050 and the major recovery valve 2048 is activate boss 2046*a*. Said major recovery valve 2048 is mounted to an ink supply tube 2049, and, when activated, sends the ink to an ink supply opening of the cap 2006 through the tube 2018. Thus the face of the recording head 2001 is washed with the ink.

Now reference is made to FIG. 2 for explaining the arrangement of the tubes.

In the upper part of the ink cartridge 2023 there is provided an ink outlet 2021*b* with a three-way joint, of which an aperture supplies ink to the head 2001 through a tube 2051. Ink supply to the major recovery valve 2048 is also made through a tube 2049 connected to said three-way joint.

The ink recovered by the pump 2020 in the minor or major recovery operation is guided to the used ink reservoir in the ink cartridge 2023, through the used ink tube 2022.

In the following there will be explained the control system of the ink jet recording apparatus of the present embodiment.

FIG. 7 shows an example of said control system, in which a host computer or a data transfer unit 1001 releases print image data in the unit of a horizontal line (recording direction). The image data of each line are transferred to the printer by a trigger signal 1016 from a control unit 1002, in synchronization with clock signals of a predetermined frequency.

The control unit 1002 controlling the entire printer is provided, for example, with an MPU 1002-1 composed for example of a microprocessor; a ROM 1002-2 storing the control program for the MPU 1002-1, other programs shown in the flow charts to be explained later and various data; a RAM 1002-3 used as a work area for storing sheet width, count of data calculated from said sheet width, number of received lines calculated from said count etc.; a counter 1002-4 for counting the number of sheet feeds and of carriage moving pulses; a timer 1002-5 for measuring time in response to the instruction of the MPU 1002-1 and sending an interruption signal to the MPU 1002-1 after the lapse of said time; and an I/O port 1002-6 for input/output of various data and control signals.

An image buffer memory 1003 stores the image data from the host computer 1001, at least by the number of recording elements of the head 1 (128 lines in the present embodiment). The image data from the host computer or data transfer unit 1001 are stored in succession in the image buffer memory 1003, under the control of the control unit 1002.

A receiving circuit 1004 is provided with a counter 1004-1 capable of setting the number of received image data of a line, and sends a detection signal 1017 to the control unit 1002 upon reception of data of a number set by the control unit 1002. The receiving circuit 1004 is also provided with a black dot discrimination circuit for discriminating the presence or absence of black dots.

A data converter 1005 reads the data of lines of a number corresponding to that of the recording elements of the head 2001 (for example 128 lines) by each vertical column (128 dots) and releases said data corresponding to the recording position of the head 2001. The recording head 2001 has 128 recording elements aligned in a vertical column, and effects the recording operation by a horizontal scanning motion.

A driver 1007 drives the recording elements of the head 2001, according to the print data from the data converter.

There are also provided a carriage motor 1008 for moving the carriage 2002 supporting the head 2001 in the horizontal scanning direction; a carriage motor driver 1009 for driving the carriage motor 1008 based on the data from the control unit 1002; a sheet feeding motor 1010 capable of feeding the sheet by the pitch of recording elements of the head 2001; a driver 1011 for driving the sheet feeding motor 1010; a cassette motor 1012 for a cassette feeder, for sheet feeding from the cassette by an instruction from the host computer or data transfer unit 1001 or an instruction from a key panel 1014-1 of an information input unit 1014 to be explained later; and a driver 1013 for driving the cassette motor. In the present embodiment, the carriage motor 1008, sheet feeding motor 1010 and cassette motor 1012 are composed of stepping motors.

The information input unit 1014 sends various information as detection signals 1018 to the control unit 1002. There are provided a key panel 1014-1 used for entering the size, such as A4 or B5 size, of the recording medium such as paper; a sheet end sensor 1014-2 for detecting the leading and trailing end of the recording medium at the feeding thereof; a sheet width detector 1014-3 mounted on the carriage and used for prohibiting the recording outside the recording medium based on the detected width thereof; a cassette sheet detector 1014-4 for detecting whether the sheet cassette feeder is mounted; an ink detector 1014-6 for detecting the presence of ink in the ink cartridge 2023 for supplying the head 2001 with the recording ink; an ink cartridge detector 1014-7 for detecting the presence of the ink cartridge 2023; and a multi-feeder sheet detector 1014-8 for detecting the presence of sheet in a multi-feeder. A command signal 1015, for example indicating the sheet size, from the host computer or data transfer unit 1001, enables the host computer 1001, in addition to the information input unit 1014, to designate the sheet size.

There are further provided a pump home position detector 1014-9 for determining the reference position of the capping mechanism and pump mechanisms specific to the ink jet recording apparatus; a carriage home position detector 1014-10 for determining the reference position of the carriage 2002 supporting the recording head 2001; and a door detector 1014-11 for detecting the opening and closing of a door provided in the main body.

Figure 8:
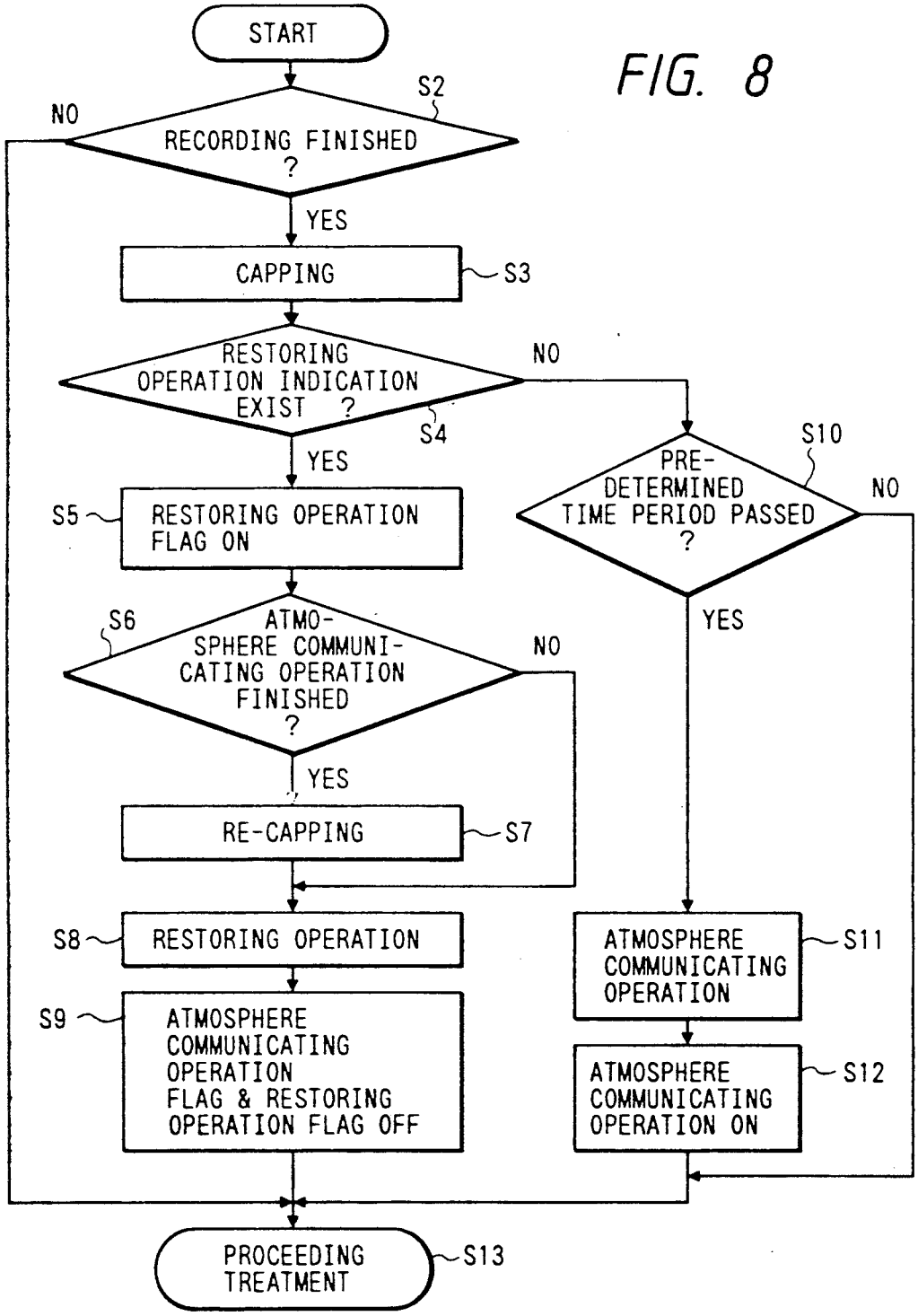
FIG. 8 is a flow chart showing an example of control sequence in the stand-by state for recording in said embodiment.

FIG. 8 shows an example of printer control sequence in a stand-by state in the present embodiment.

After a recording operation, if there is identified the absence of data input from the host computer or data transfer apparatus 1001 for a predetermined period (5 seconds in the present embodiment) (step S2), capping is applied on the face of the head 2001 for isolating said face from the air (step S3), for preventing the emission failure resulting from ink solidification in the emission openings of the head when the face thereof is exposed to the air.

Then it is determined whether a recovery or restore operation is instructed by the information input unit 1014 shown in FIG. 7 (step S4). If the capping is maintained for a long time without said instruction, the pressure in the closed space in front of the face of the head 2001 increases due to the heat of the head and the temperature in the apparatus, destroying the meniscus in the emission openings and including ink leakage from the head 2001, eventually rendering the recording operation impossible. Consequently, if the capped state continues for a predetermined period (for example 1 minute) without said instruction, the communicating hole **2006*b* is opened to bring the pressure on the face to the atmospheric pressure, and the hole 2006*b* is then closed (step S11). Said opening and closing are achieved by a small reciprocating motion of the carriage 2002, namely by moving the carriage 2002 toward right, in FIG. 2, from the capped position, and then returning to the original position. Then an air communication operation flag is set, and the energization of the carriage motor 1008** is terminated to prevent heat generation thereof (step S12).

On the other hand, if the recovery operation is instructed, a recovery operation flag is turned on (step S5). Then it is determined from the state of the air communication operation flag, whether the air communicating operation by the carriage motor 1008 in the step S11 has been completed. If completed, the carriage motor is completely released from the hold state, so that the carriage 2002 is now subjected to biasing force of the slider return spring 2032, toward right in FIG. 4, transmitted by the slider arm **2013*a*. Thus the carriage 2002 is moved to right in FIG. 2 as the biasing force is larger than the friction between the carriage 2002 and the carriage shaft 2003**, so that the ensuing recovery operation becomes impossible.

This is because the communicating hole **2006*b* of the cap 2006 is not necessarily closed, as the carriage motor 1008 is deactivated after the aforementioned air communicating operation. In the present invention, therefore, the capping is repeated to close the communicating hole of the cap (step S7), and the recovery (minor) operation is started thereafter. Stated differently, the recovery operation (step S8) is started after the carriage is securely moved to the home position. On the other hand, if the communicating operation has not been completed, the motor is still in the hold state though with a low voltage, whereby the communicating hole 2006*b*** is securely closed. Thus the recovery operation can be started without repeating the capping operation. Then, after the recovery operation, a step S9 turns off the communicating operation flag and the recovery flag, and the sequence proceeds to the next stage.

The present invention is not limited to the structure explained above, but may assume various structures.

For example, the major recovery by guiding the ink to the head face is conducted after a movement of the carriage from the position of minor recovery by suction, but it is also possible to conduct the major recovery at said position. Also the structure relating to the major recovery may be dispensed with if sufficient effect can be obtained with the minor recovery alone. Also the minor recovery is not limited to the suction method explained above, but can also be conducted by pressurizing the ink supply system of the recording head, thereby forcedly emitting the ink.

The carriage motor is composed of a stepping motor in the present embodiment. However the present invention is likewise applicable to a case of employing a DC motor, which uses only that current necessary and enough for maintaining the position in the setting at the home position, but is cut off from the power supply after the air communicating operation.

EMBODIMENT 2

Figure 9:
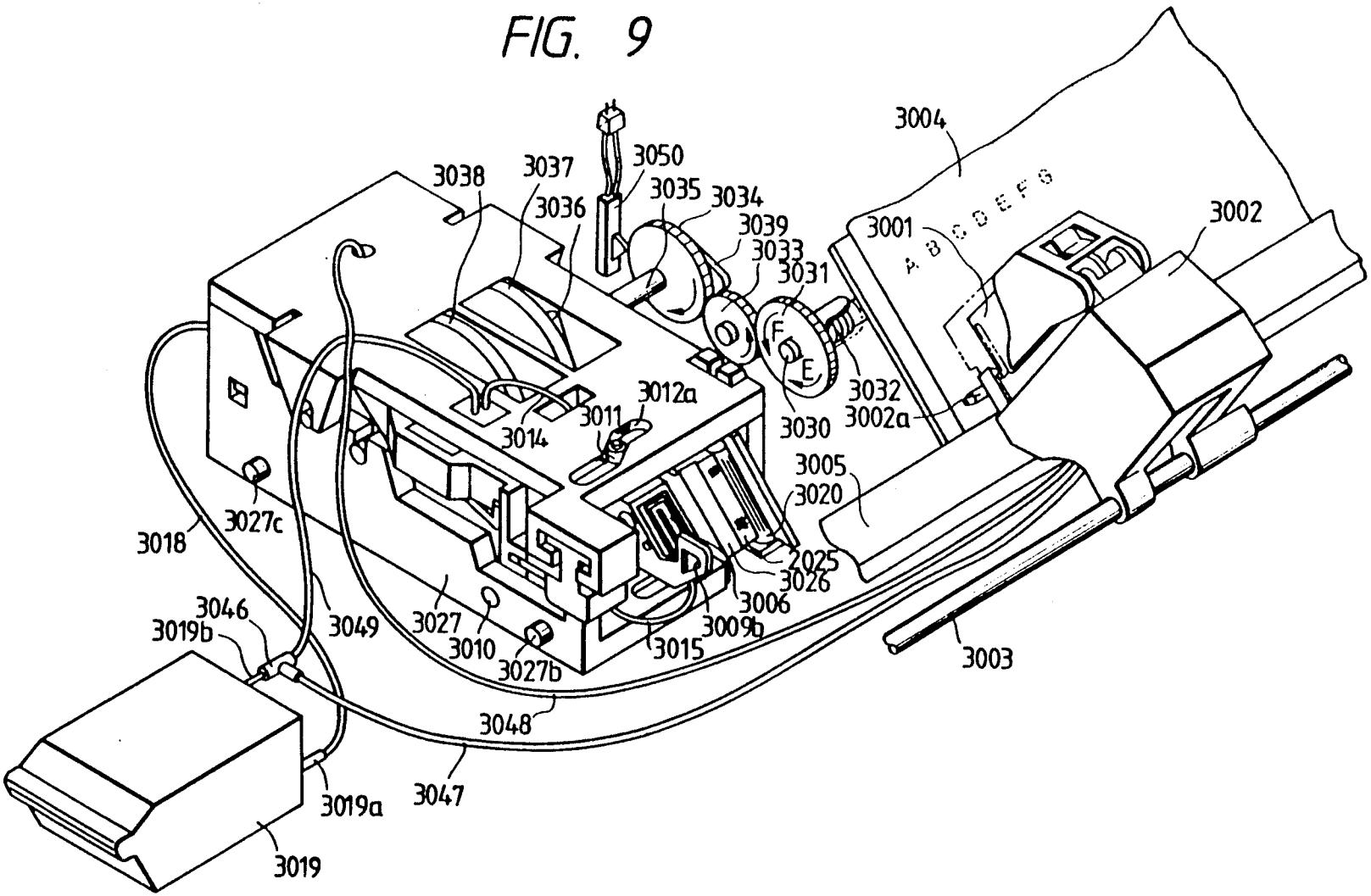
FIG. 9 is a perspective view of a principal part of another embodiment of the ink jet recording apparatus of the present invention.
Figure 10:
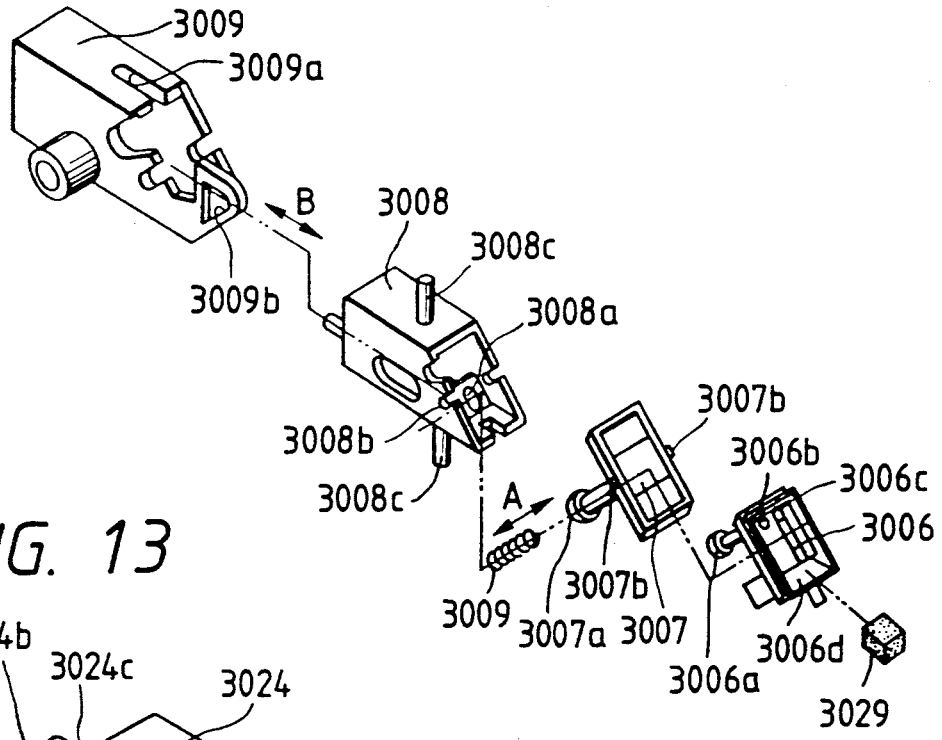
FIGS. 10 and 11 are respectively an exploded perspective view and a schematic view of an example of a cap unit provided in the recovery unit of said embodiment.
Figure 13:
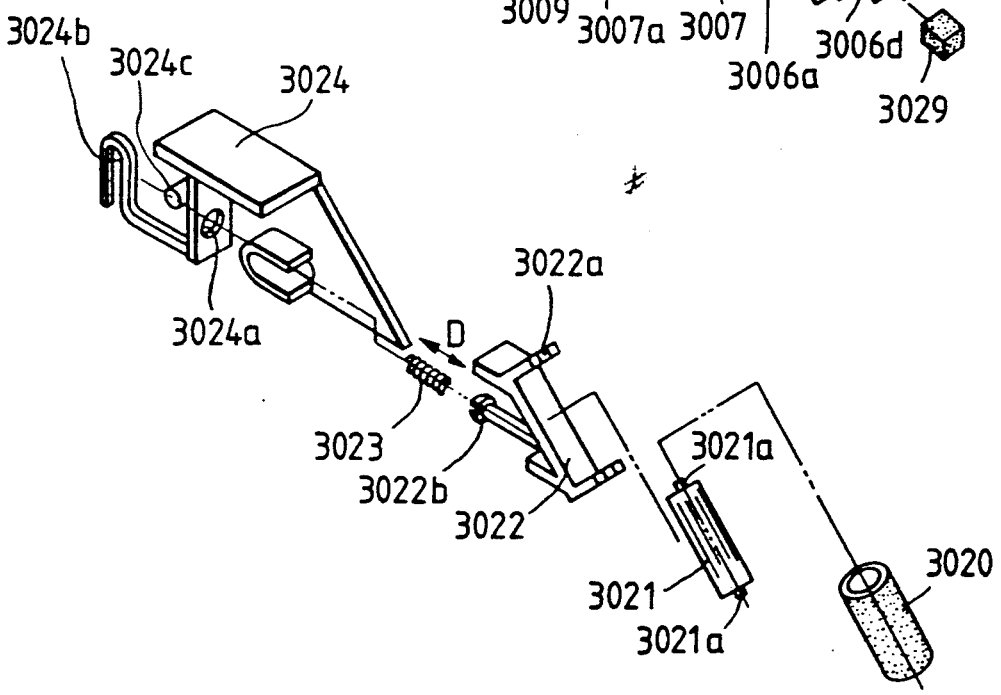
FIG. 13 is an exploded perspective view of an example of the rubbing unit provided in said recovery unit.
Figure 11:
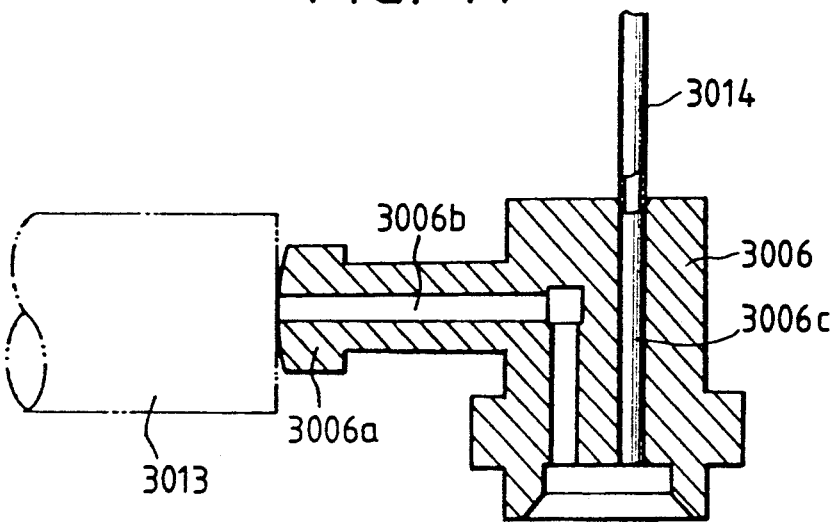
Figure 12:
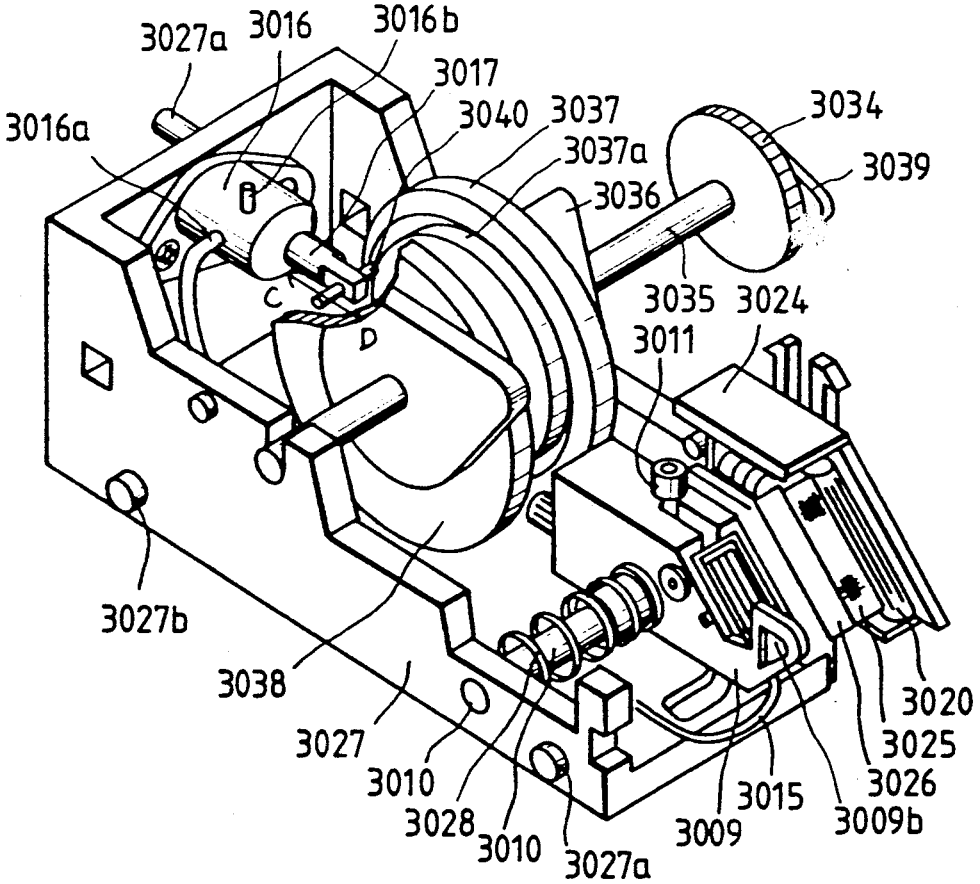
FIG. 12 is a perspective view of the recovery unit shown in FIG. 9, with the outer casing thereof removed.

FIG. 9 is a perspective view showing the principal part of the ink jet recording apparatus constituting a second embodiment of the present invention; FIG. 10 is an exploded perspective view of a cap part provided in the recovery means; FIG. 11 is a schematic view thereof; FIG. 12 is a perspective view of the recovery means without the outer cover thereof; and FIG. 13 is an exploded perspective view of a rubbing unit provided in the recovery means.

A recording head 3001 emits or discharges ink as droplets by means of thermal energy. A carriage 3002, on which the head 3001 is fixed, is moved laterally by a timing belt integral with the carriage 3002 along a carriage shaft 3003, through the function of carriage motor (not shown), and recording is made on a recording medium 3004 in the course of said movement.

A pinch roller stay 3005 rotating about a shaft (not shown) according to the thickness of the recording medium 3004. A part of the carriage 3002 slides, by the weight thereof, on said pinch roller stay 3005, thereby maintaining a constant gap between the recording surface of the recording medium 3004 and the head 3001, thereby ensuring the recording of high quality.

A recovery system is provided for stabilizing the ink emission from the emission openings of the head 3001.

When the head 3001 does not effect the recording for a predetermined period, a face, on which the emission openings are formed, of the head 3001 is closed with a cap 3006 in order to prevent emission failure resulting from the ink solidification in the emission openings.

FIG. 10 shows a closing mechanism for said cap 3006. The cap 3006 is supported by a cap holder 3007 which is in turn supported by a holder 3008. A spring 3009 is provided between the cap holder 3007 and the holder 3008, and a finger 3007*a* of the cap holder 3007 is inserted and engages with a hole 3008*a* of the holder 3008. Pins 3007*a* of the cap holder 3007 are positioned in U-shaped grooves 3008*b* of the holder 3008, whereby the cap holder 3007 can oscillate integrally with the cap 3006, according to the face of the head 3001. On and under the holder 3008 there are provided two pins 3008*c*, which are positioned in U-shaped grooves 3009*a* of the slider 3009 to constitute the cap unit. The cap holder 3007 is movable relative to the holder 3008 in a direction A, and the holder 3008 can oscillate relative to the slider 3009 in a direction B.

The slider 3009 supports the cap 3008, cap holder 3007 and holder 3008, and, with the movement of the carriage 3002 along the carriage shaft 3003 from the recording area toward the recovery system, the pin 3002*a* of the carriage 3002 enters a hole in the arm of the slider 3009, whereby said slider 3009 moves, together with the carriage 3002, along the slider shaft 3010 toward left as shown in FIG. 9. In this state, a roller 3011 inserted on a pin 3008*c* of the holder 3008 moves along a groove 3012*a* of the flat cam 3012, whereby the holder 3008 protrudes toward the head 3001, and the slider 3010 moves to the left. As a result the cap 3006 is pressed to the face, having the emission openings, of the head 3001, with a pressure of 300-500 g.

Thus, as shown in FIG. 11, an air valve 3006*a*, constituting a pin of the cap 3006, is maintained in contact with a stopper 3013 with a force of about 100 g by a mechanism to be explained later. An externally communicating hole 3006*b* is closed in this state. A major recovery cap tube 3014 is closed by a mechanism to be explained later, and a major recovery hole 3006*c* is also closed.

Referring to FIG. 9, a used ink tube 3015 is connected to a pump 3016 shown in FIG. 12, in which a negative pressure is generated when a piston 3017 is moved in a direction D (backward direction). Thus a negative pressure is also generated in the cap 3006 in pressure contact with the head 3001, whereby the ink is forcedly sucked through emission openings of the head 3001, together with the dust and sedimented ink of said emission openings, into the cap 3006, thus resolving the emission failure of the head 3001. Then, in the movement of the piston 3017 in the direction D after having reached the lower dead point, the interior of the pump 3016 is pressurized, whereby the ink sucked from the cap 3006 is discharged as used ink to a used ink reservoir of an ink cartridge 3019 through a used ink tube 3018 and a used ink intake 3019*a*. There is no change in the pressure in the cap 3006 at the discharge of the used ink, due to the pump structure.

In such state, the ink sucked from the openings of the head 3001 still remains in the cap 3006 and the used ink cap tube 3015, so that ink sticks on the face of emission openings of the head 3001. If surface tension of thus sticking ink is larger than the ink emitting force, there will result an emission failure of the ink and a smearing of the recording medium 3004 by ink scattering at the contact of a blade 3024 to be explained later, thus resulting in a significant deterioration of the image quality.

In order to eliminate the ink sticking on the face of emission openings of the head 3001 retained in the cap 3006, the carriage 3002 is slightly moved to right (2 mm in the present embodiment) so as to disengage the air valve 3006*a* of the cap 3006 from the stopper 3013, while the cap 3006 is maintained in contact with the head 3001, and the pump unit is activated in this state. Since the communicating hole 3006*b* is L-shaped as shown in FIG. 11 and is positioned in the upper portion of the cap 3006, aid is sucked into the cap 3006 through said hole. As air flows from the upper side of the cap 3006 to the lower side thereof where the used ink cap tube 3015 is mounted, the ink present in the cap 3006 and on the above-mentioned face thereof is eliminated. Subsequently a rubbing member 3020 is advanced as will be explained later, thereby giving a rubbing motion on the face of the head 3001 at the movement of the carriage 3002 from left to right, thus removing the ink and smear from said face and ensuring stable emission of the head 3001.

FIG. 13 shows said rubbing mechanism. An annular rubbing member 3020 is placed on a cylindrical rubbing inserter 3021, of which pins 3021*a* engage with U-shaped grooves 3022*a* of a rubbing holder 3022. A finger 3022*b* of a pin of the rubbing holder is inserted into a hole 3024*a* of the rubbing slider 3024 with a rubbing spring 3023, whereby the rubbing member 3020 is rendered movable in a direction D. The protruding motion of the rubbing slider 3024 is achieved by a cam to be explained later, and the returning motion is achieved by recovering force of an elastic deformation of a part 3024*b* of the rubbing slider 3024. The rubbing member 3020 protrudes by the engagement of the cam with the pin 3024*c* of the rubbing slider. Said rubbing member 3020 is composed for example of etheric polyurethane continuous pore foam.

A blade 3025 is provided between the rubbing member 3020 and the cap 3006, paper and other powder dust deposited in the nozzles during the recording operation are wiped off with said blade 3025. In the present embodiment, said blade 3025 is composed of flexible silicone rubber of a thickness of about 0.5 mm. Said blade 3025 is mounted on a part of a base member 3027 for the recovery system by means or a blade support member 3026 and is always maintained in a protruding position, so that the wiping operation with the blade 3025 is conducted whenever the head moves in front thereof.

At the recording operation, the slider 3009 is returned toward right by the slider spring 3028 as shown in FIG. 12, and the cap 3006 is provided at a position defined by the impingement of a part of the slider 3009 with a part of the base member 3027 for the recovery system supporting the blade 3025 with the blade support member 3026. Also during the recording operation, for preventing the clogging of the unused emission openings of the head 3001, said head is returned to the waiting position of the cap 3006, and all the nozzles are activated to effect idle emission at a regular interval. Also in this operation, the wiping operation with the blade 3025 is conducted at each reciprocating motion of the head 3001. Also the wiping with the blade 3025 is conducted naturally in relation to the recovery operation by above-mentioned suction, and the major recovery operation. In the idle emission, the pin 3008*c* of the holder 3008 is in contact with a lowered portion of the cam face 3012*a* of the flat cam 3012, whereby the cap 3006 is separated from the head 3001. The ink emitted in the idle emission is absorbed in a polymer absorbent member 3029 provided in the cap 3006, and is sucked to the pump 3016 at the activation thereof. Also when the pin 3002*a* of the carriage 3002 enters the hole 3009*b* of the arm of the slider 3009, together with the leftward movement of the carriage 3002, the pin 3008*c* of the holder 3008 climbs the slop of the cam face 3012*a* of the flat cam 3012, whereby the cap 3006 is brought into pressure contact with the head 3001, thus achieving the capping operation. If the emission failure is not easily solvable, for example by firm ink adhesion to the emission openings of the head 3001, there is conducted a major recovery operation. In said major recovery operation, the head 3001 is placed 2 mm to left, in FIG. 9, of the position of the minor recovery, while the air valve 3006*a* of the cap 3006 is maintained in contact with the stopper 3013 whereby the externally communicating hole is closed.

Figure 14:
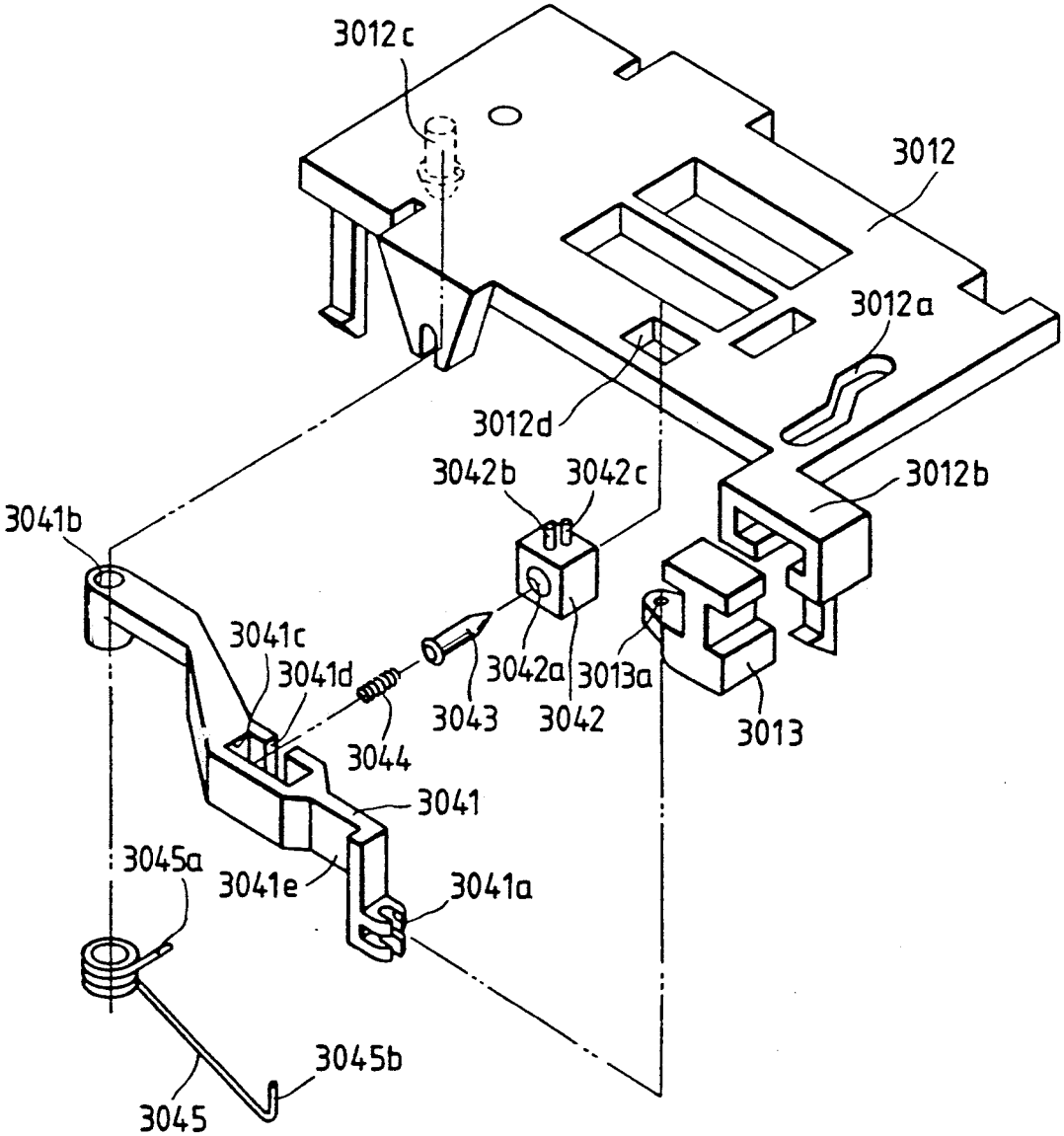
FIG. 14 is an exploded perspective view of an example of the mechanism for major recovery operation.

FIG. 14 shows an example of the mechanism for the major recovery operation. In a part 3012*b* of the flat cam 3012, the slider 3013 is smoothly movable in the moving direction of the carriage 3002. A protruding portion 3013*a* of the stopper 3013 fits into a U-shaped groove 3041*a* of a stopper lever 3041. A supporting part 3041*b* of the stopper lever 3041 is fitted on a pin 3012*c* of the flat cam 3012. In a part 3012*d* of the flat cam 3012 there is provided a major recovery valve 3042 provided therein with a hole 3042*a* communicating with finer holes 3042*b*, 3042*c*, which are opened or closed by a valve piston 3043. A major recovery spring 3044 is provided between the valve piston 3043 and a hole 3041*c* of the stopper lever 3041, and the valve piston 3043 is supported in a U-shaped groove 3041*d* of the stopper lever 3041. At the supporting portion of the stopper lever 3041 there is provided a stopper spring 3045, of which an end 3045*a* impinges on a support portion (not shown) of the flat cam 3012, while the other end 3045*b* impinges on a part 3041*e* of the stopper lever 3041 Thus there is obtained a returning force when the stopper 3013 is moved to left.

Figure 15:
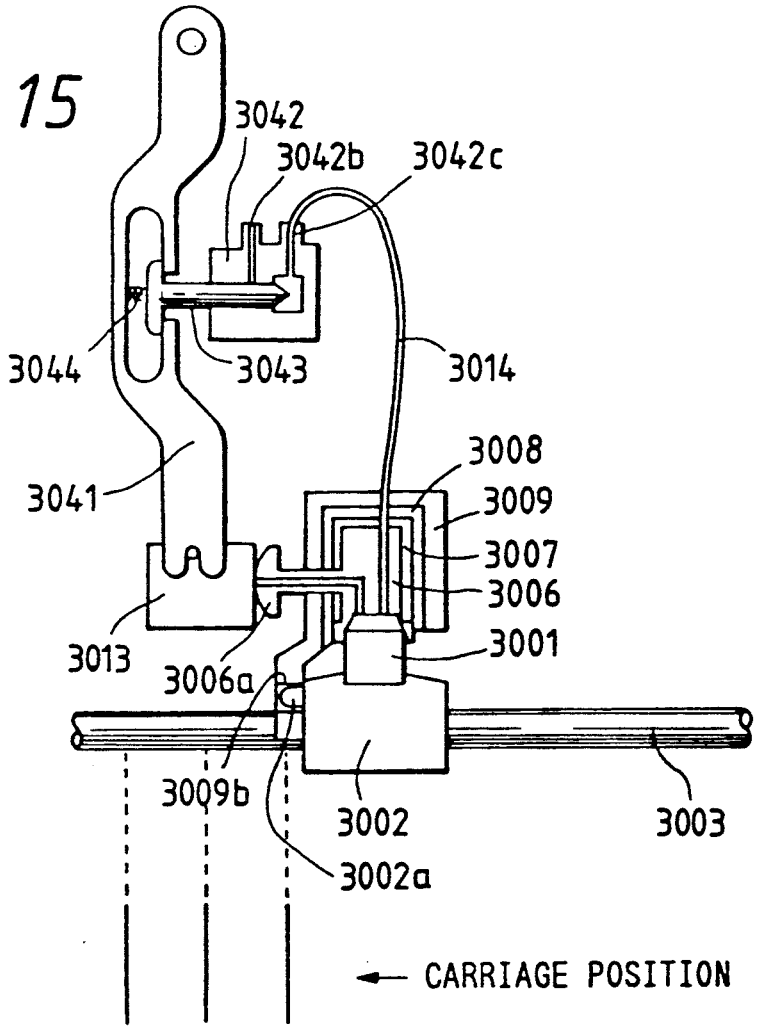
FIG. 15 is a schematic view for explaining various recovery operations.

In the following there will be explained the function of the above-explained mechanism, with reference to a schematic view of the recovery system shown in FIG. 15. When the pump for minor recovery is activated, the valve piston 3043 is not in contact with the inner wall of the hole 3041*c* of the stopper lever 3041, and is pressed to the major recovery valve 3042 by means of the major recovery spring 3044, whereby the fine holes 3042*b*, 3042*c* are closed. The air valve 3006*a* is in contact with the stopper 3013, and the externally communicating hole 3006*b* is closed. When the carriage is moved, from this position, to left by 2 mm for the major recovery operation, the inner wall of the hole 3041*c* of the stopper lever 3041 comes into contact with the valve piston 3043 to extract said valve piston 3043 from the major recovery valve 3042, whereby the fine holes 3042*b*, 3042*c* are opened. The externally communicating hole 3006*b* and the stopper 3013 are maintained in the contacting state Consequently ink can be supplied from the ink cartridge to the upper part of the cap 3006, through a tube to be explained later. At the idle emission, the holes 3042*b*, 3042*c* are not open, and the air valve 3006*a* is not in contact with the stopper 3013.

Now reference is made to FIG. 9 for explaining the arrangement of the tubes.

In the upper part of the ink cartridge 3019 there is provided an ink outlet 3019*b* with a three-way joint, of which an aperture is connected to a sub tank (not shown) of the carriage 3002 through an ink supply tube 3047, and ink supply is made from said sub tank to the head 3001 through a tube (not shown). A sub tank tube 3048 is connected from a part of the sub tank to an ink intake 3016*b* of the pump 3016 for retaining the internal liquid level and for bubble elimination. The fine hole 3042*c* of the major recovery valve 3042 and the cap 3006 is connected by the major recovery cap tube 3014, while the fine hole 3042*b* of the major recovery valve 3042 is connected to the ink outlet 3019*b* of the ink cartridge 3019 through a major recovery tube 3049 and the three-way joint 3046. The used ink is recovered from the pump 3016 to the ink cartridge 3019, through a used ink tube 3018 connecting a part 3027*a* of the base member 3027 of the recovery system and the used ink intake 3019*a* of said ink cartridge 3019. The used ink from the lower part of the cap 3006 is sucked to the ink intake 3016*a* of the pump 3016 through the used ink cap tube 3015.

Thus, in the major recovery operation, the cap 3006 is maintained contact with the face of the head 3001 as in the minor recovery operation, so that a motion of the piston 3017 of the pump 3016 in the direction C causes ink flow from the major recovery hole 3006*c* into the cap 3006. At the same time ink flows from the openings of the head 3001 into the cap 3006, and is subsequently discharged to the used ink reservoir by the pump 3016. After such pump operation is repeated for example four times, ink is stored in the space formed between the cap 3006 and the face of the head 3001. Then the head 3001 is moved to right by 2 mm, and the fine holes 3042*b*, 3042*c* of the major recovery valve 3042 are closed by returning the valve piston 3043 to the original position by the stopper spring 3045 of the stopper lever 3041. The system is maintained in this state for example for a minute in order to soften the solidified ink with the fresh ink, and then the pump is activated to discharge the ink contained in the space between the cap 3006 and the face of the head 3001 and to simultaneously suck the ink from the nozzles of the head 3001.

Then the head 3001 is further moved to right by 2 mm to open the externally communicating hole 3006*b* of the air valve 3006*a* of the cap 3006, and the pump is activated to cause an air flow from said hole 3006*b* to the used ink outlet 3006*d* of the cap 3006. In this manner the ink is eliminated from the face of the head 3001 and from the cap 3006. The major recovery operation is conducted as explained above.

The recovery system unit of the present embodiment can be easily fixed to the main body, by means of a pins 3027*a*, 3027*b* of the base member 3027, and is maintained in position by fingers of the flat cam 3012 and the base member 3027.

Figure 16:
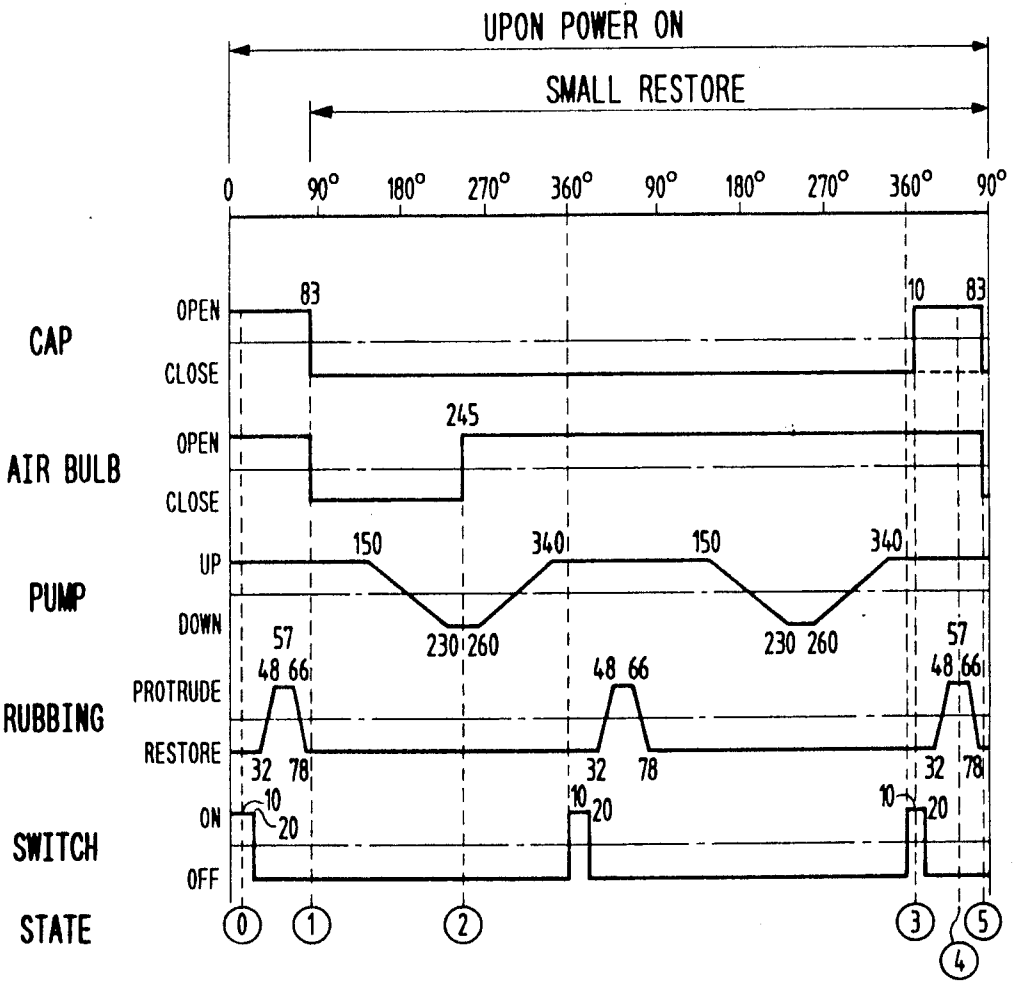
FIG. 16 is a cam chart at the start of power supply and at the minor recovery operation in the present embodiment.
Figure 17:
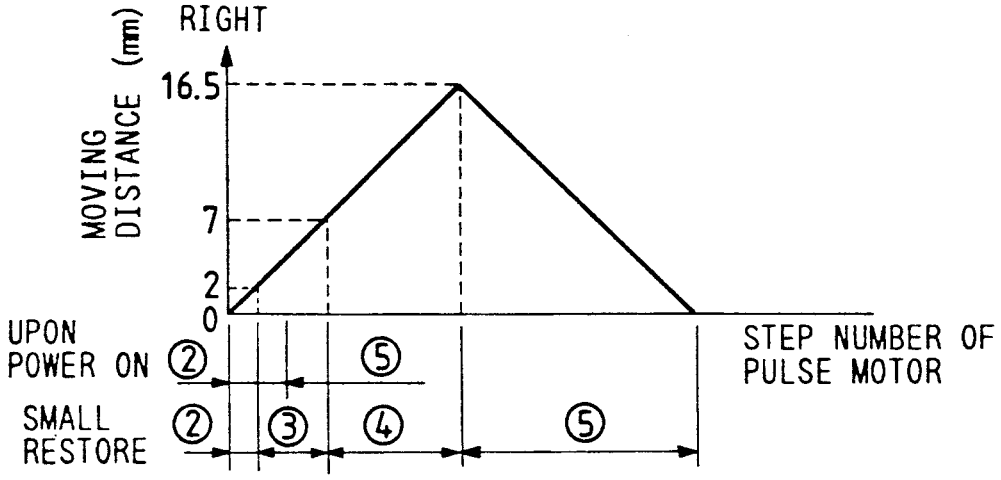
FIG. 17 is a chart showing the function of the recording head.
Figure 19:
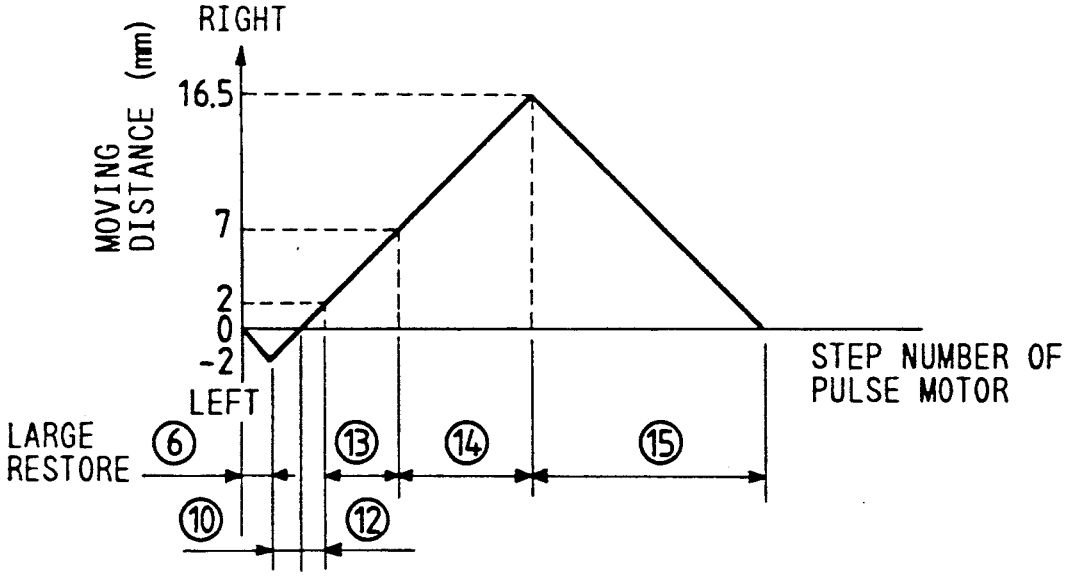
FIG. 19 is a chart showing the function of the recording head at the major recovery operation.
Figure 18:
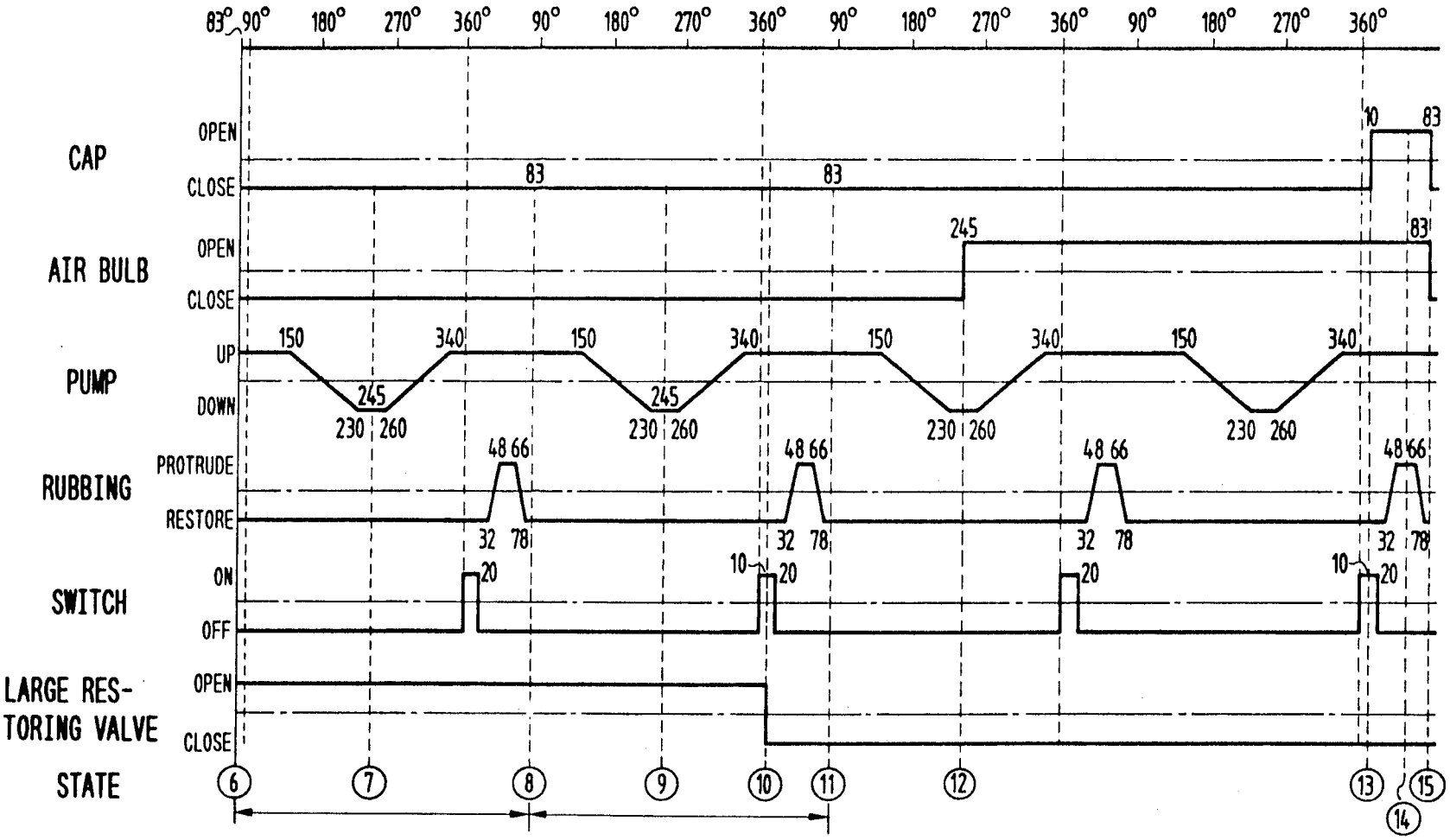
FIG. 18 is a cam chart in the recovery operation of the present embodiment.

FIG. 16 is a cam chart at the start of power supply and at the minor recovery operation. FIG. 17 is a chart showing the movement of the head 3001 at the start of power supply and at the minor recovery operation, wherein the abscissa indicates the number of steps of a stepping motor for driving the carriage 3002 supporting the head 3001, and the ordinate indicates the distance of movement and direction thereof of the head 3001. Similarly FIG. 18 is a cam chart at the major recovery operation, and FIG. 19 is a chart showing the movement of the head 3001 at the major recovery operation. In the following there will be explained the function of the above-explained structure shown in FIGS. 9 and 12, with reference to these charts.

At first, at the start of power supply, the recovery system is initialized as shown in FIGS. 16 and 17. In this operation the home position cam 3039 rotates until the home position switch is turned on, and is further rotated by 10° to reach a state (0). In this state the piston 3017 of the pump 3016 reaches the upper dead point, and the rubbing member 3020 is in a waiting state. The head 3001 is in an arbitrary position within the movable range. The cap 3006 and the face of the head 3001 are not in mutual contact, so that the air valve 3006*a* is naturally in the open state. Then, after the cam rotates to an absolute angle 83°, the head 3001 moves to a position (1) where the air valve 3006*a* is closed. Hereafter the rotational position of the cams is represented by absolute angle, and the position of the head 3001 is taken as the original point.

The cams start to rotate in said state (1), and the pump 3016 starts a suction at 150° and reaches the lower dead point at 230°. The rotation of the cams is interrupted at 245° for example for 0.8 seconds, thereby achieving sufficient ink suction, and the head 3001 is thereafter moved to right by 2 mm to open the air valve 3006*a* (state (2)). Then the cams further rotate to 260° where the piston 3017 starts to ascend. The piston reaches the upper dead point at 340°. Then the cams are rotated by (2×360°+83°) at a constant speed while the head 3001 is maintained in the same position. Then the head 3001 is moved to left by 2 mm to reach a state (5)). At the start of power supply, the function is represented by a double-dot chain line in the chart shown in FIG. 16, in a period from (2×360°+10°) to (2×360°+83°). From said state (5), the head 3001 executes the recording operation according to the data transfer, and returns to the state (5) after said recording operation.

The minor recovery operation will be explained from the state (1), as the starting state (5), is identical with the state (1). The function from the state (1) is identical with that at the start of power supply until a state (3) at (2×360°+10°). At said state (3) the head is moved to right by 5 mm. then the cams rotate, and the rubbing member starts to protrude from (2×360°+32°), and retains the protruding state from (2×360°+48°). The rotation of the cams is interrupted at (2×360°+57°), and the head 3001 is moved further to right by 9.5 mm.

In this state the face of the head 3001 is cleaned by rubbing with the rubbing member 3020. Upon further rotation of the cams, the rubbing member 3020 starts to recede at (2×360°+66°), and returns to the waiting state at (2×360°+78°). The cams stop at (2×360°83°), and the head 3001 moves to left by 16.5 mm where the cap 3006 is brought into contact with the face of the head 3001. Also the valve 3006*a* is closed, so that the cap 3006 reaches the totally closed state (5), and the system awaits the data transfer.

In the following there will be explained the major recovery operation with reference to FIGS. 18 and 19.

In the major recovery operation, the head 3001 is moved to left by 2 mm from the above-mentioned waiting state (5) for data transfer, and the carriage is moved in impingement with the stopper 3015 to open the major recovery valve 3042. Thereafter the cams start to rotate, and the piston 3017 of the pump 3016 starts to descend at 150° and reaches the lower dead point at 230°. At a state (7) at 245°, the rotation of the cams is interrupted for example for 0.8 seconds. The negative pressure generated in the pump 3016 sucks the ink from the emission openings of the head 3001 and the major recovery hole 3006*c* provided in the upper side of the cap 3006. Upon further rotation of the cams thereafter, the piston 3017 starts to ascend from 260°, then reaches the upper dead point at 340°, and reaches a state (8) at (360°+83°). The above-mentioned stage I is repeated three times. Then, at a state (9) at (3×360°+245°), the cams stop for 0.8 seconds. Then the cams rotate at a constant speed to a state (10) at (4×360°+10°), wherein the head 3001 is moved to right by 2 mm. In this state the valve piston 3043 returns to the original position, and the major recovery valve 3048 is closed. This state is retained for about 1 minute for softening the ink solidified in the nozzles of the head 3001. Subsequently the cams rotate to a state at (11) at (4×360°+83°). The states (8) to (11) are called stage II.

The subsequent operations are identical with those in the minor recovery operation. Thus, in the major recovery operation of the present embodiment, the stage I is conducted three times and the stage II is conducted once before entering the minor recovery operation.

The capping upon the above major or large recovery operation and the minor or small recovery operation or the like is carried out by the abutment with the slider 3009 corresponding the movement of the carriage 3002 to the predetermined position, but in order to the abutted state, the construction below is adopted in the present embodiment.

Figure 20:
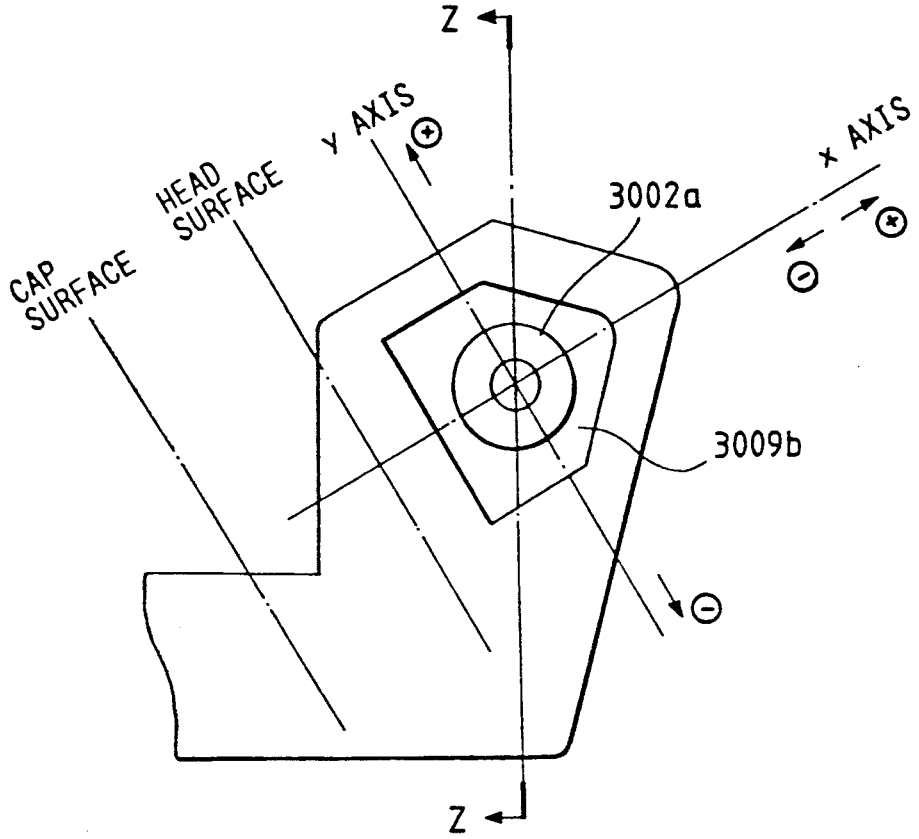
FIGS. 20 and 21 are respectively a lateral view and a cross-sectional view along a line Z—Z, showing the positional relationship of a pin and a hole in the uncapped state.
Figure 21:
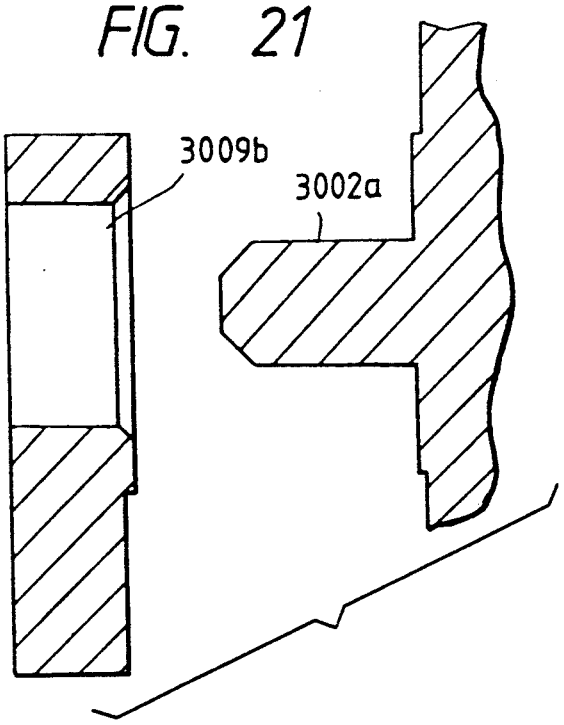
Figure 22:
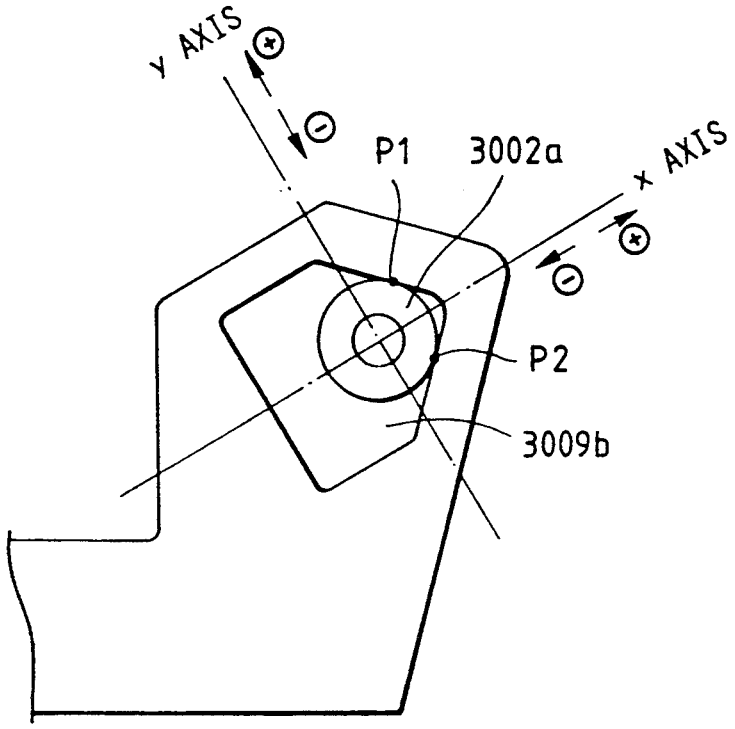
FIG. 22 is a lateral view showing the positional relationship of said pin and hole in the capped state.

FIGS. 20 to 22 are enlarged views of the hole portion 3009*b* of the slider 3009 and the nib or slit portion 3002*a* of the carriage 3002, in which drawings FIGS. 20 and 21 respectively is a side view of a non-capped state and a cross section along line Z—Z of the same. FIG. 22 is a side view of the capped state. In these drawings, y axis corresponds to the direction parallel to the head surface, and the cap surface is provided parallel with it.

In the non-capped state, as shown in FIGS. 20 and 21, the nib portion 3002*a* of the carriage 3002 and the hole portion 3009*a* of the slider 3009 are positioned with keeping sufficient gap therebetween. From this state, when carrying out capping by the operation of the carriage 3002, the head 3001 tends to go beyond contact with the cap 3006, but as shown in FIG. 22, the nib portion 3002*a* and the hole portion 3009*b* abut each other to be fixed relatively thereby holding the capping state. This capping state is stable since the nib portion 3002*a* and the hole portion 3009*a* are abut each other at two points $P_1$ and $P_2$.

For example, the nib portion 3002*a* is dislocated relative to the position of hole portion 3009*b* in a ⊕ axis direction in FIG. 20, the nib portion 3002*a* abuts the inner surface of the hole portion 3009*b* at the side of point $P_1$, and the carriage is pressed in a ⊖ direction of the x axis corresponding to the capping operation to reach the capping state shown in FIG. 22. In other words, even if the nib portion is shifted relative to the hole portion in the x axis direction, y axis direction, the capping is carried out in the position as shown in FIG. 22. Due to two point contact, secure positioning is made compared with the surface to surface abutment or the hole to shaft engagement.

In the above embodiment, the nib portion as the convex portion is formed on the carriage and the hole portion as the concave portion, but configuration or position of them can be freely deformed as far as two point contact can be obtained.

EMBODIMENT 3

Figure 23:
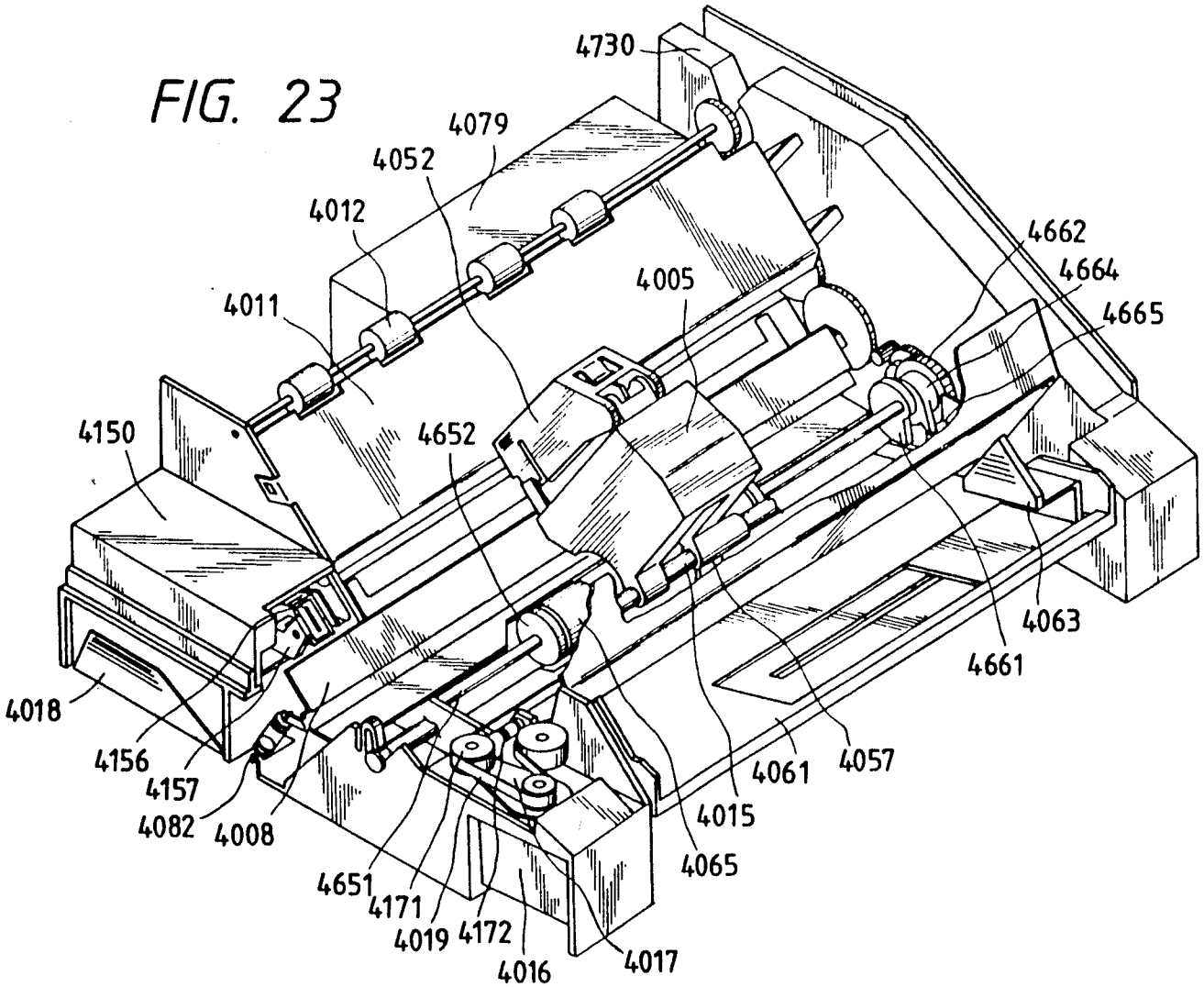
FIG. 23 is an external perspective view of still another embodiment of the ink jet recording apparatus of the present invention.
Figure 24:
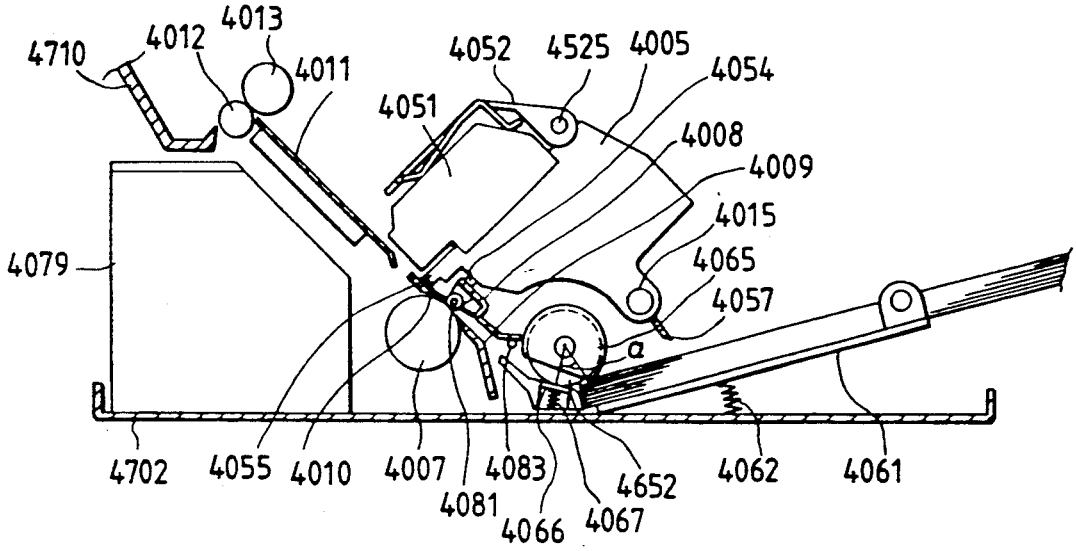
FIG. 24 is a cross-sectional view of a principal part of the apparatus shown in FIG. 23.
Figure 25:
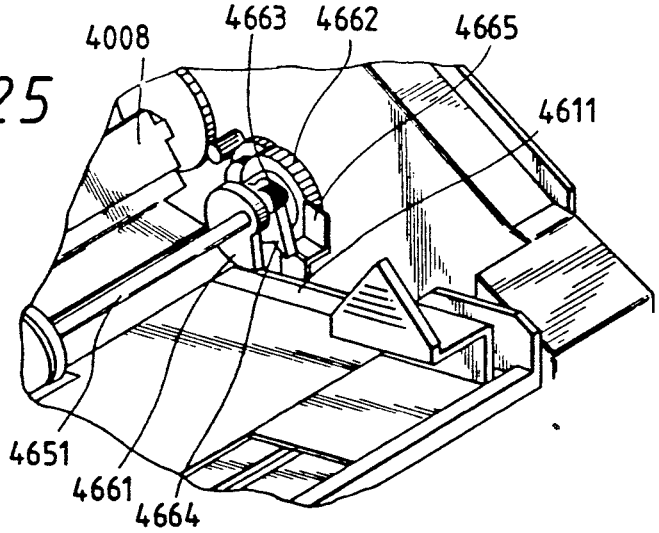
FIG. 25 is a enlarged perspective view of a sheet feeding mechanism shown in FIG. 23.

FIG. 23 is an external perspective view of an ink jet recording apparatus constituting the third embodiment of the present invention; FIG. 24 is a cross-sectional view of a principal part of the apparatus shown in FIG. 23; and FIG. 25 is a partial magnified view of a sheet feeding mechanism in FIG. 23.

In these drawings, there are shown a pressure plate 4061 for stacking recording sheets for supply to the ink jet recording apparatus; a pressure plate spring 4062 for provided behind the pressure plate 4061 and for biasing the same upwards; a sheet width limiting plate 4063 provided slidably on the pressure plate 4061 and defining the position of the recording sheets stacked on the pressure plate 4061 according to the width of said sheets; a separating roller 4065 fixed on a separating roller shaft 4651 for separating the recording sheets one by one; and circular pressure rollers 4652 provided on both sides of the separating rollers 4652 provided on both sides of the separating roller 4065 to be freely rotatable on the separating roller shaft 4651. A pressure plate pressing-down cam 4661 is fixed on an end of the separating roller shaft 4651, and a separating roller gear 4662 is rotatably fitted next to said cam 4661. A spring clutch 4663 is provided between the cam 4661 and the gear 4662, and is in a non-transmitting state (off) when a lock ring 4664 provided therearound is locked by a locking finger 4665, and in a transmitting state (on) when said lock ring is disengaged free from the locking finger 4665. Said locking finger 4665 is in a position to be disengaged from the locking ring 4664 by a dynamic contact with a protruding part of a carriage 4002 to be explained later.

The pressure plate 4061 is provided with a cam receiving part 4611 in a position to engage with the cam 4661. When the pressure plate 4061 is pressed down by the cam 4661, the recording sheets are separated from the separating roller 4065 and the pressure roller 4652, but, when the cam 4661 is disengaged from the cam receiving part 4611, the pressure plate 4061 is pushed up by the spring 4062 to press the recording sheets with the separating roller 4065.

At the downstream side of the pressure plate 4061, in the sheet feeding direction, there is provided a separating pad 4066 which is for separating the recording sheets one by one and is biased toward the pressure roller 4652 and the separating roller 4065 by a pag spring 4067. The pressure roller 4652 has a circular shape in the cross section perpendicular to the roller shaft 4651, while the separating roller 4065 is substantially semi-circular in said cross section. The radius of the separating roller 4065 is slightly larger than that of the pressure roller 4652. Thus the separating pad 4066 is in contact with the separating roller 4065 within the arc thereof, and is otherwise in contact with the pressure roller 4652.

The separating roller 4065 has a relative small diameter in a range of 20–30 mm. Therefore, as shown in FIG. 24, the angle o from the contact point of the pressure plate 4061 with the separating roller 4065 to the contact point of the separating pad 4066 with the separating roller 4065 becomes large, so that the front end of the recording sheet picked up by the separating roller 4065 has a large entering angle to the separating pad 4066 with respect to the pressure plate 4061. Thus the separating performance is not deteriorated even if the pressure of the separating pad by the spring 4067 is small. In contrast to the usual diameter (ca. 40 mm) requiring a separating pad pressure of about 300 g, the smaller diameter (20–30 mm) enables satisfactory separation with a pressure of about 50 g. Consequently the back tension from the pressure roller 4652 and the separating pad 4065 becomes smaller during the feeding of the recording sheet by a feeding roller 4007, and stable sheet feeding is made possible.

Also the fluctuation in the amount of feeding when the rear end of the recording sheet is disengaged from the pressure roller 4652 and the separating pad 4066 can be suppressed.

The sheet feeding roller 4007 is provided on the transport path for feeding the recording sheet, fed by the above-mentioned mechanism, further to a recording position opposed to a recording head. Opposed to said roller 4007 and across the recording sheet there is provided a pinch roller 4081, which is rotatably supported on a pinch roller stay biased by pinch roller springs 4082 at both ends. The pinch roller stay 4008 is also rendered rotatable about a support point 4083. A sheet guide member 4009 guides the recording sheet, fed by the sheet feeding mechanism, to a position between the feeding roller 4007 and the pinch roller 4081. A sheet pressure plate 4010 holds the recording sheet on the pinch roller 4081.

The sheet feeding roller 4007 is driven by a motor (not shown), and the driving force is transmitted in one-step with gears of such reducing ratio that the sheet is advanced by a recording line corresponding to a turn of the motor. It is therefore possible to prevent the white streak or overlapping between the recording lines in the recorded image, and to cancel the eccentricity of the motor and the motor gears giving rise to image deterioration. Also unnecessary error components are excluded, as the speed reduction from the driving motor to the feeding roller 4007 is done in one step with minimum components.

A hot plate 4011 with a heater in the back accelerates the ink fixation on the recording sheet, in cooperation with the power supply unit to be explained later. Said hot plate 4011 is practically maintained in a range of 40°-90° C. A sheet discharge roller 4012 is positioned opposite to a pinch roller 4013, which is spur-shaped to be in point-contact with the recorded face of the recording sheet, thereby preventing smear by friction when the ink is not fixed completely. The feeding speed of the discharge roller 4012 is made several per cent larger than that of the sheet feeding roller 4007, thereby giving tension to the sheet and maintaining close contact of the sheet with the hot plate 4011 and flatness of the sheet at the recording position.

The hot plate 4011 is positioned at the downstream side of the recording elements of the recording head 4051 in the transporting path of the sheet, so that the heat of the hot plate 4011 is not given directly to said recording elements. Between the sheet guide member 4009 and the hot plate 4011 there is provided a gap, in which the detection of sheet width is conducted with a sheet width sensor, composed of a reflective photosensor provided on a carriage 4005, whereby error detected from the reflection of the guide member can be prevented.

A carriage 4005 is laterally movably mounted on a guide shaft 4015, and is moved by a motor 16 through a belt 4019. A pulley 4171 is mounted on a tension plate 4017 rotatable coaxially with the motor 4017, and a constant tension is given to the belt 4019 by a tension spring 4172.

The carriage 4005 is rendered rotatable around the guide shaft 4015, and a pressing portion 4054 of the carriage 4005 presses the face of the pinch roller stay 4008 by the weight of the carriage 4005. The pressing portion 4054 constitutes a slider and slides on said pinch roller stay 4008 together with the movement of the carriage 4005. The pressing portion 4054 is composed of a highly slidable resin, such as teflon. The carriage 4005 is further provided in the vicinity of the recording head 4051, with a protruding portion 4055 which protrudes by 0.3-0.5 mm beyond the ink emitting face of the recording head 4051, but does not touch the sheet pressure plate 4010 in the normal state.

The recording head 4051 is provided with ink emitting openings arranged in the sheet advancing direction, and emission energy generating elements generating energy used for emitting the ink therefrom respectively corresponding to said orifices. The position of the recording head 4051 with respect to the carriage 4005 is determined by the engagement of a projection of the head 4051 with a hole in the carriage 4005. A fixing lever 4052 is rotatably mounted, around a point 4525, on the carriage 4005. The fixing lever 4052 serves to fix the recording head 4051 on the carriage 4005 by the pressure of an elastic part of said fixing lever, when a hook of said lever engages with a hook of the carriage 4005.

The carriage 4005 is also provided with a sheet width sensor for detecting the width and the presence of the sheet at the movement of the carriage 4005. The detecting position of said sheet width sensor is located in the vicinity of the most downstream one of the openings of the recording head 4051 in the sheet feeding direction. Also in the vicinity of the portion of the carriage 4005 engaging with the guide start 4015, there is provided a protruding portion 4057 for disengaging the aforementioned locking finger 4665 of the sheet feeding mechanism, and said protruding portion effects said disengagement in contact with the locking finger 4665 at a predetermined position in the moving path of the carriage outside the recording area. Furthermore the carriage 4005 is provided with a cap positioning pin, which is used for defining the capping position at the capping of the face of recording elements of the recording head 4051 when the carriage 4005 is retracted to the position of a recovery device in the non-recording state.

An emission recovery device 4150, for conducting the capping of the ink emitting face of the recording head 4051 and the ink suction thereof, is positioned in one of the areas outside the recording area in the moving path of the carriage 4005.

Figure 26:
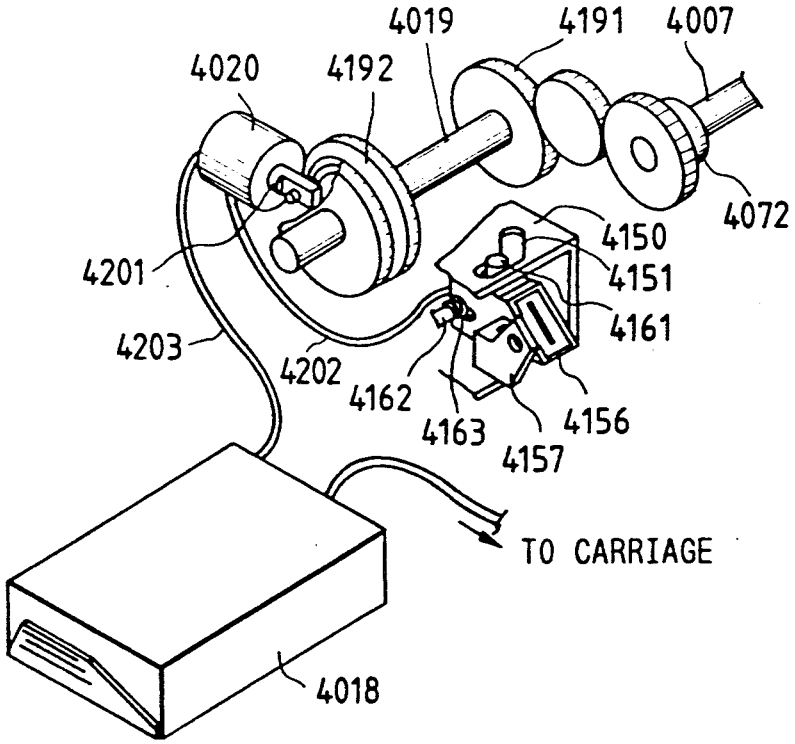
FIG. 26 is an exploded perspective view of the details of the emission recovery unit shown in FIG. 23.

FIG. 26 is an exploded perspective view of the details of said emission recovery device, wherein shown are a cap 4156 for covering the ink emitting face of the recording head 4051, said cap 4156 being provided with a positioning lever 4157 for engaging with the aforementioned positioning pin of the carriage 4005; and an ink cartridge 4018 for storing the ink to be supplied to the recording head 4051 and provided with a used ink recovery unit for storing the used ink sucked in the capping operation.

A pump 4020 having a piston 4201 with a one-directional valve is connected to the cap 4156 through a suction tube 4202 and with the used ink recovery unit of the ink cartridge 4018 through a used ink tube 4203. Thus the used ink sucked in the cap 4156 is discharged to said used ink recovery unit.

The driving force of the pump 4020 is transmitted to the piston 4201 through a transmission unit such as a recovery system gear 4072 provided at an end of the sheet feeding roller 4007, and a conversion cam 4192.

A power supply unit 4079 is fixed on a bottom plate 4702 in such a manner that a heat radiating plate of said unit is positioned below the discharge tray.

The function of the above-explained mechanism is as follows.

When the recording operation is not conducted, the carriage is covered by the cap 4156 of the recovery unit 4150, and is in a stand-by state for recording. Upon receiving data to be recorded from a host computer or a data transfer unit, the carriage 4005 starts to move for disengaging the locking finger 4665 positioned opposite to the recovery unit on the moving path. When the locking finger 4665 is disengaged, the locking ring 4664 is freed, whereby the rotation of the separating roller gear 4662 can be transmitted to the separating roller shaft 4065 and the pressure plate pressing-down cam 4661, which thus start to rotate by the motor. After the motor is activated, the carriage 4005 returns to and waits in a position not hindering the engagement of the locking finger 4665, by the elasticity thereof, with the locking ring 4664. When the cam 4661 starts to rotate, the pressure plate 4061 moves upwards by the spring 4062 to contact with the separating roller 4065, whereby the recording sheets are advanced to the position of the separating pad 4066 by the rotation of the separating roller 4065. Said recording sheets are subjected to the shearing force of the separating roller 4065 and the separating pad 4066, and only one sheet is advanced to the position of the sheet feeding roller 4007 and the pinch roller 4081 by the rotation, within one turn, of the separating roller 4651. When the finger of the locking ring 4664 reaches the position of the locking finger 4665, the locking ring 4665 is blocked and the rotation of the separating roller 4065 is stopped.

The sheet feeding operation is normally completed by a turn of the separating roller 4065, but plural turns thereof will be needed if the length to the sheet feeding roller 4007 is structurally longer than the peripheral length of said separating roller 4065. In such case, the carriage waits in a position disengaging the locking finger 4665 until the last turn starts. After the leading end of the sheet is detected by the sheet end sensor positioned between the feeding roller 4007 and the separating roller 4065 in the course of sheet feeding operation, the recording sheet is advanced by a predetermined amount and then the feeding roller 4007 is stopped, whereby the sheet feeding operation and the positioning of the leading end of the sheet are completed.

Subsequently the carriage 4005 returns to the side of the recovery unit 4150, and, in the course of said returning motion, the presence and width of the sheet are detected by the sheet width sensor provided on the carriage 4005. If the sheet feeding operation is conducted in normal manner, there is detected the width of the sheet, or the size thereof, in order to prevent the recording operation outside the sheet. If the recording sheet is not detected, there is identified an error whereby the operation is interrupted.

In order to avoid such failure in the sheet feeding operation, the disengagement of the locking finger 4665 by the carriage 4005 is conducted at least twice in the sheet feeding operation.

After the sheet feeding operation is completed in this manner, the carriage 4005 reciprocates in the lateral direction along the recording sheet, and the recording operation is conducted while the sheet is advanced by the feeding roller 4007 upon recording of each line by the recording head 4051. The gap between the recording head 4051 and the recording sheet is defined by the pressing portion 4054 of the carriage 4005 sliding on the pinch roller stay 4008. Since the pinch roller 4081 is provided on said stay 4008, the stay 4008 moves toward the carriage 4005 when the recording sheet is inserted between the feeding roller 4007 and the pinch roller 4081. Consequently said gap is maintained constant regardless of the thickness variation of the recording sheet, as the pinch roller stay moves accordingly.

The sheet after recording passes over the hot plate 4011 for ink fixation, and is advanced to the nip between the discharge roller 4012 and the discharge pinch roller 4013. After the rear end of the sheet is disengaged from the feeding roller 4007 and the pinch roller 4081, the sheet is advanced by the discharge roller 4012 and the pinch roller 4013, and, after the recording of the last line, the sheet is forwarded to the sheet discharge tray 4710. The sheet discharged to said tray 4710 is subjected to ink fixation by the heat radiating from the power supply unit 4079 positioned therebelow.

If the recording sheet is thick, such as envelope or postcard, the protruding portion 4055 of the carriage slides on the sheet pressure plate 4010 advanced toward the carriage by the thickness of said sheet, when said sheet is disengaged from the feeding roller 4007 and the pinch roller 4081, so that the ink emitting face of the recording head 4051 is prevented from direct contact with the recording sheet.

The recording operation on a recording sheet is completed in this manner, and similar operation is thereafter repeated.

Figures 27, 27A:
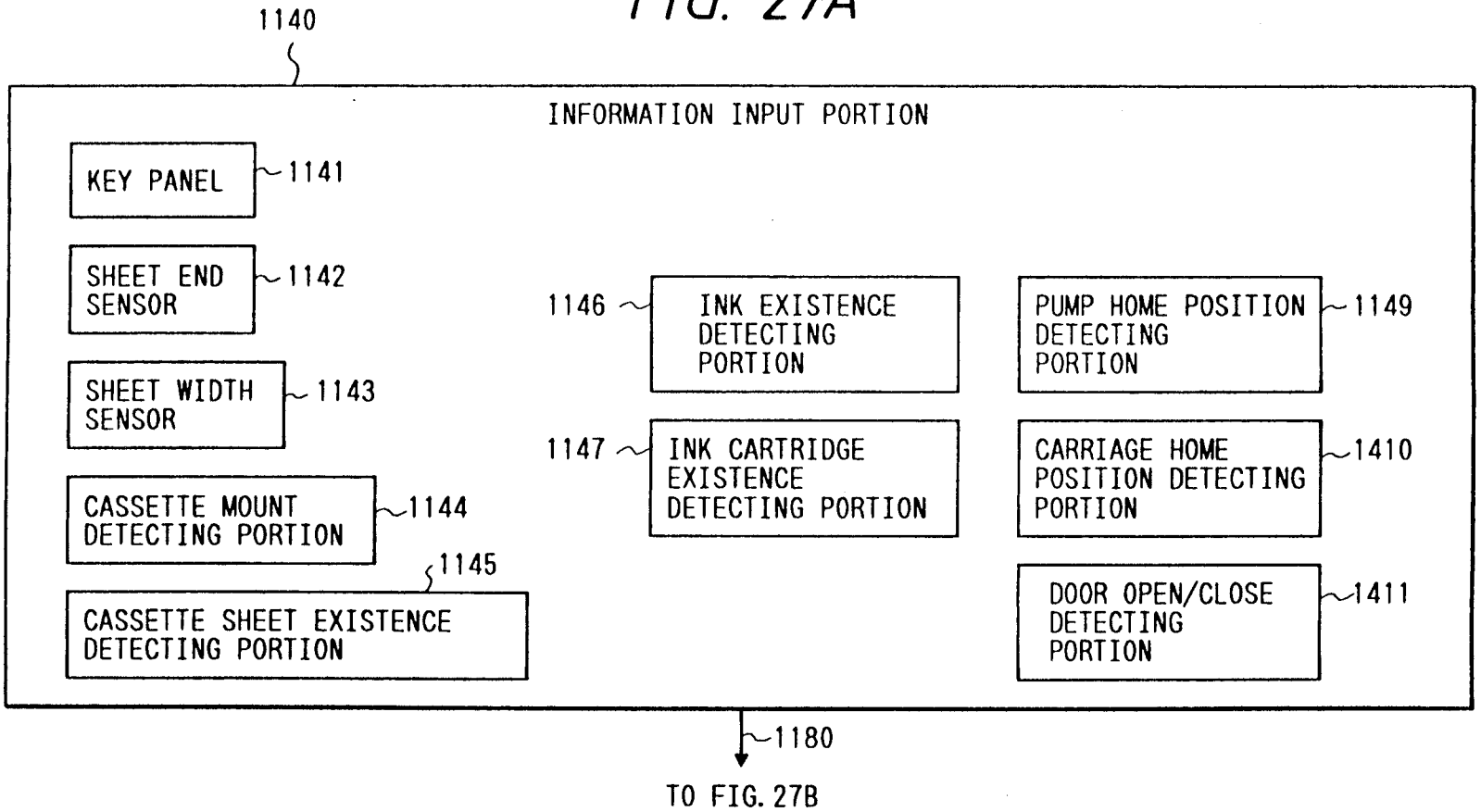
FIG. 27 is a block diagram of the control system of the ink jet recording apparatus shown in FIGS. 23 to 25.
Figure 27B:
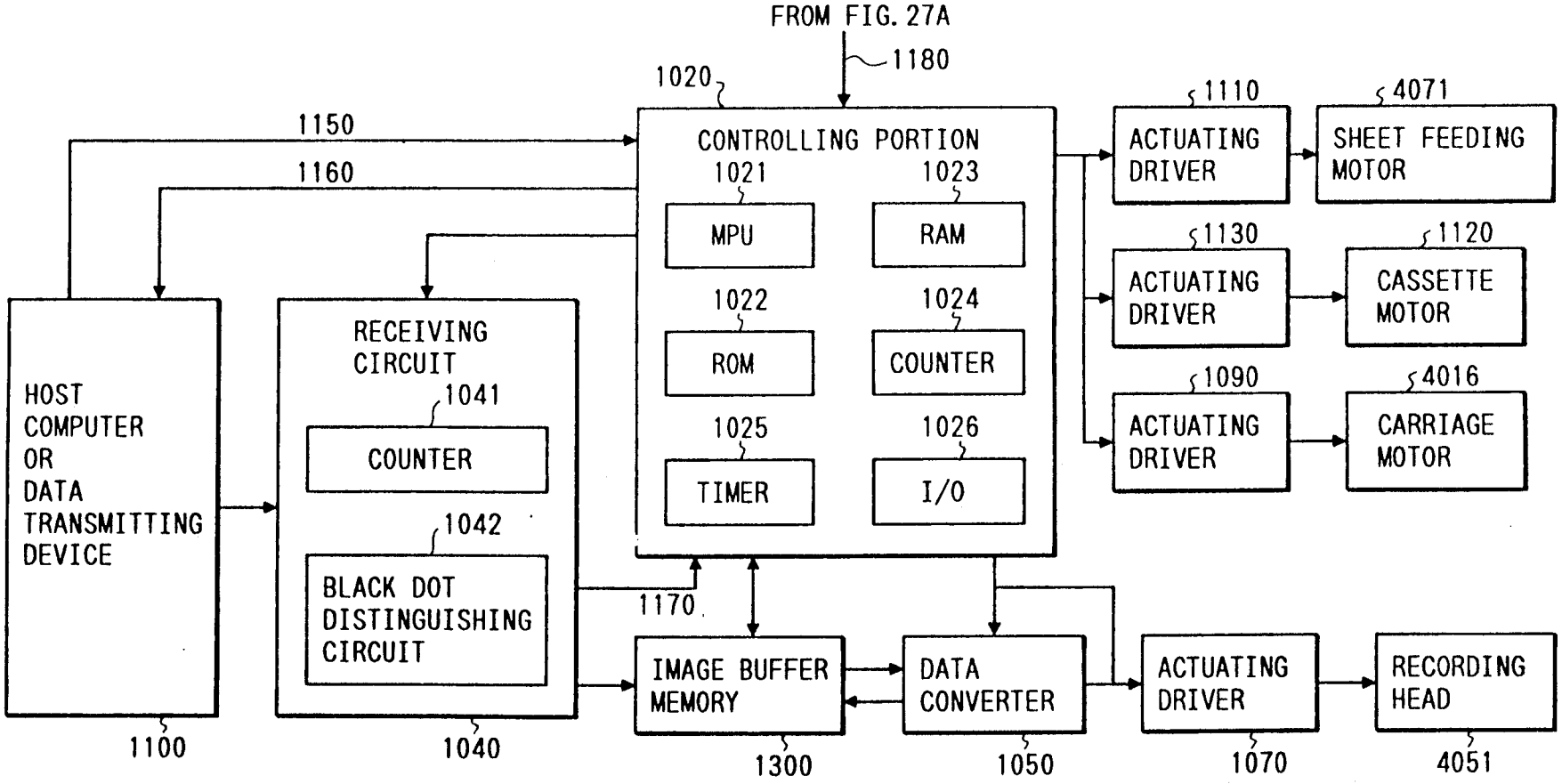

FIG. 27 is a block diagram of the above-explained recording apparatus (hereinafter called "printer").

A host computer or a data transfer unit 1100 releases print image data in the unit of a horizontal line (recording direction). The image data of each line are transferred to the printer by a trigger signal 1160 from a control unit 1020, in synchronization with clock signals of a predetermined frequency.

The control unit 1020 controlling the entire printer is provided, for example, with an MPU 1021 composed for example of a microprocessor; a ROM 1022 storing the control program for the MPU 1021, other programs shown in the flow charts to be explained later and various data; a RAM 1023 used as a work area for storing sheet width, count of data calculated from said sheet width, number of lines calculated from said count etc.; a counter 1024 for counting the number of sheet feedings and of carriage moving pulses; a timer 1025 for measuring time in response to the instruction of the MPU 1021 and sending an interruption signal to the MPU 1021 after the lapse of said time; and an I/O port 1026 for input/output of various data and control signals.

An image buffer memory 1300 stores the image data from the host computer 1100, at least by the number of recording elements of the head (128 lines in the present embodiment). The image data from the host computer or data transfer unit 1100 are stored in succession in the image buffer memory 1030, under the control of the control unit 1020. A receiving circuit 1040 is provided with a counter 1041 capable of setting the number of received image data of a line, and sends a detection signal 1170 to the control unit 1020 upon reception of data of a number set by the control unit 1020. The receiving circuit 1040 is also provided with a black dot discrimination circuit for discriminating the presence or absence of black dots.

A data converter 1050 reads the data of lines of a number corresponding to that of the recording elements of the head 4051 (for example 128 lines) by each vertical column (128 dots) from image buffer memory 1300 and releases said data corresponding to the recording position of the head 4051.

The ink jet recording head 4051 of this embodiment has 128 ink openings consisting of vertically aligned openings and the liquid path provided with corresponding emission energy generating elements, and effects the recording operation by a horizontal scanning motion.

A driver 1070 drives the recording elements of the head 4051, according to the print data from the data converter.

There are also provided a carriage motor 4016 for moving the carriage 3002 supporting the head 4051 in the horizontal scanning direction; a carriage motor driver 1090 for driving the carriage motor 4016 based on the control data from the control unit 1020; a sheet feeding motor 4071 capable of feeding the sheet by the pitch of recording elements of the head 4051; a driver 1110 for driving the sheet feeding motor 4071; a cassette motor 1120 for a cassette feeder, for sheet feeding from the cassette by an instruction from the host computer or data transfer unit 1100 or an instruction from a key panel 1141 of an information input unit 1140 to be explained later; and a driver 1130 for driving the cassette motor. In the present embodiment, the carriage motor 4016, sheet feeding motor 4071 and cassette motor 1120 are composed of stepping motors.

The information input unit 1140 sends various information as detection signals 1180 to the control unit 1020. There are provided a key panel 1141 used for entering the size, such as A4 or B5 size, of the recording sheet; a sheet end sensor 1142 for detecting the leading and trailing end of the recording sheet at the feeding thereof; a sheet width detector 1143 mounted on the carriage and used for prohibiting the recording outside the recording sheet, based on the detected width thereof; a cassette detector 1144 for discriminating whether the sheet cassette feeder is mounted; a cassette sheet detector 1145 for detecting the presence of sheets in the cassette; an ink detector 1146 for detecting the presence of ink in the ink cartridge for ink supply to the recording head 51; an ink cartridge detector 1147 for detecting the presence of said ink cartridge; a pump home position detector 1149 for determining the reference position of the capping mechanism and pump mechanisms specific to the ink jet recording apparatus; a carriage home position detector 1410 for determining the reference position of the carriage 4005 supporting the recording head 4051; and a door detector 1141 for detecting the opening and closing of a door provided in the main body.

A command signal 1150, indicating the sheet size, recording instruction etc., from the host computer (data transfer unit) 1100 enables the designation of sheet size from the host computer 1100, in addition to the information input unit 1140.

Figure 28:
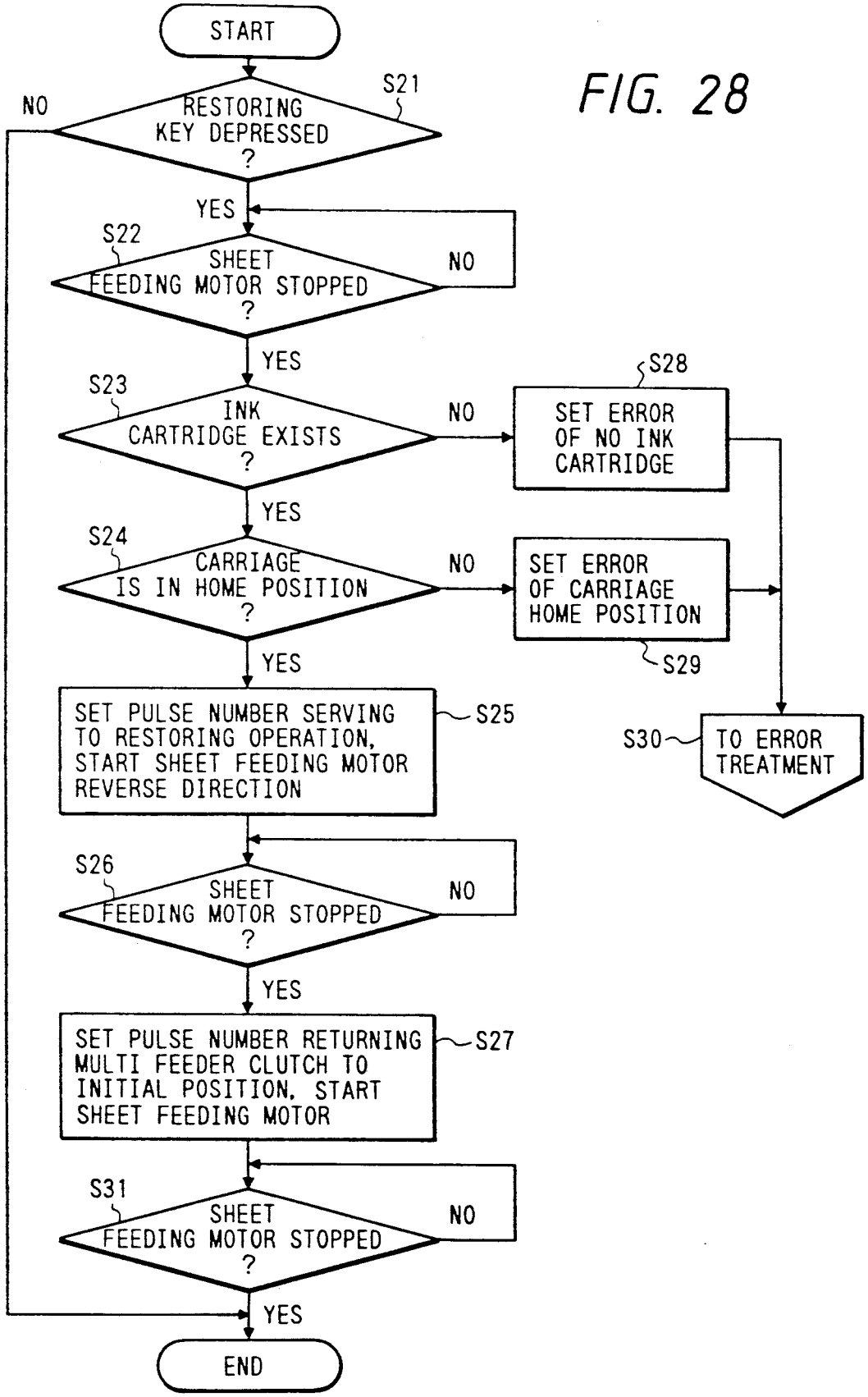
FIG. 28 is a flow chart of the control sequence of another embodiment of the present invention.

FIG. 28 is a flow chart of the control sequence of the embodiment shown in FIGS. 23 to 27. Said control sequence will be explained in the following with reference to FIG. 28.

At first a step S21 discriminates whether a recovery key in the key panel 1141 of the information input unit 1140 has been depressed. If not, the sequence is terminated. If depressed, the sequence proceeds to a step S22. As the recovery operation is conducted by the reverse rotation of the sheet feeding motor, it has to be stopped once. Said step S22 discriminates whether the feeding motor 4071 is stopped, and, if not, waits until the motor is stopped. When the motor is stopped, a step S23 discriminates whether the ink cartridge to be used for the recovery operation is correctly loaded, and, if not, the sequence proceeds to a step S28 for indicating an error, and the sequence proceeds then to an error process. In the presence of the ink cartridge, the sequence proceeds to a step S24.

In the present embodiment, as the capping operation of the recovery system is conducted by the movement of the carriage, the completion of capping is identified by whether the carriage is in the home position. Thus, if the carriage is not in the home position, a step S29 indicates a carriage home position error, and the sequence proceeds to an error procedure in a step S30. When the carriage is in the home position, a step S25 sets, in the sheet feeding counter 1024 of the control unit 1020, a number of pulses required for driving the sheet feeding motor for the purpose of sucking the viscous ink present in the vicinity of orifices and in the openings of the recording head, thereby driving the sheet-feeding motor in the reverse direction. Then a step S26 discriminates whether the sheet feeding motor has been stopped, and, if not, waits until said motor is stopped.

After the recovery operation explained above, a step S27 sets, in the sheet feeding counter, a number of pulses required for returning the spring clutch of the multi-feeder to the initial state of sheet feeding, thereby rotating the sheet feeding motor in the forward direction. Then a step S31 discriminates whether the sheet feeding motor has been stopped, and, if not, waits until it is stopped. The sequence is terminated when the motor is stopped.

Though the foregoing embodiment is limited to an ink jet recording apparatus, the present invention is likewise applicable to any recording apparatus in which a motor used for sheet feeding is utilized for driving other components in opposite rotation, and accordingly not limited to the ink jet recording apparatus having poor discharge recovery system.

EMBODIMENT 4

Figure 29:
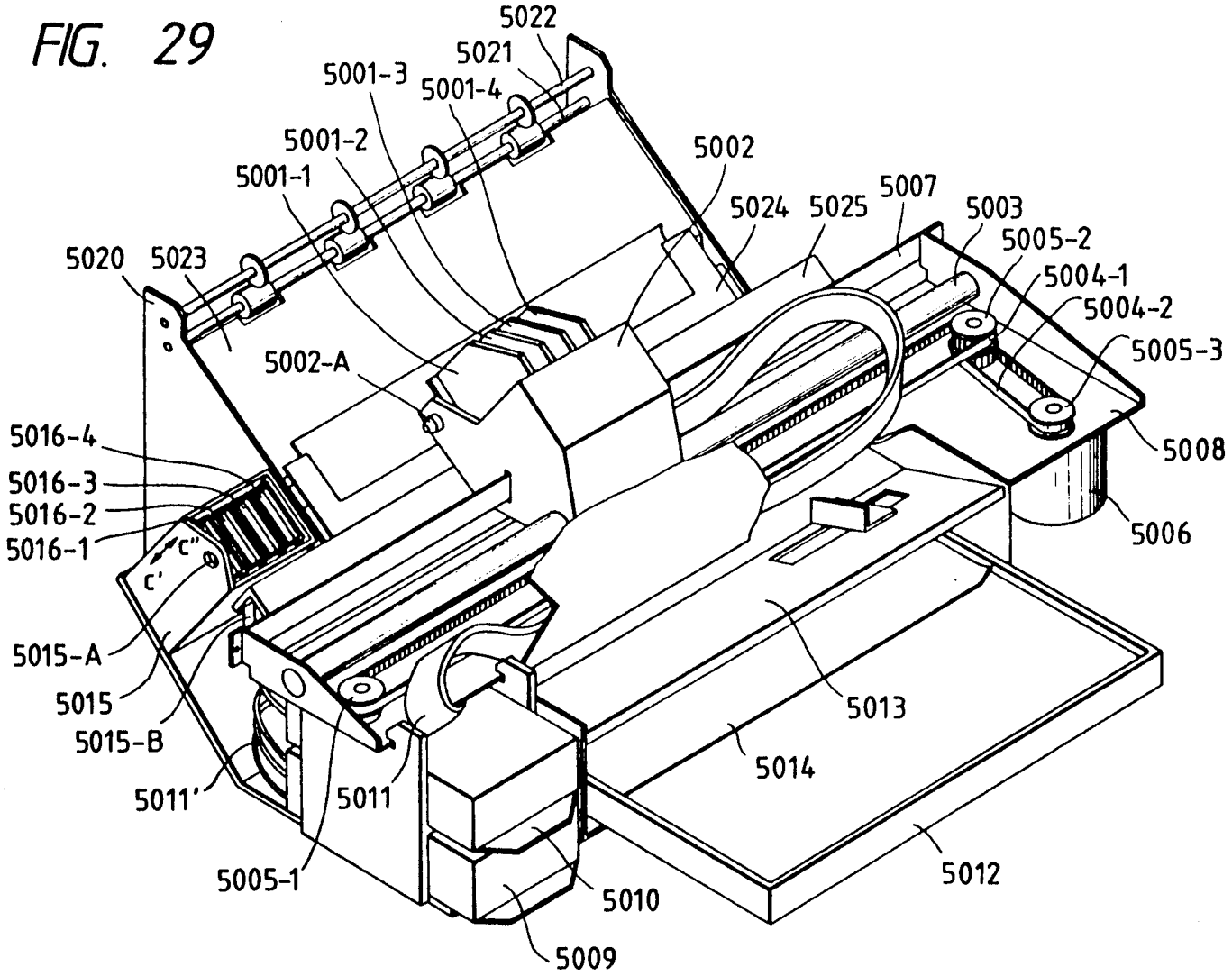
FIG. 29 is a perspective view of still another embodiment of the ink jet recording apparatus of the present invention.
Figure 30:
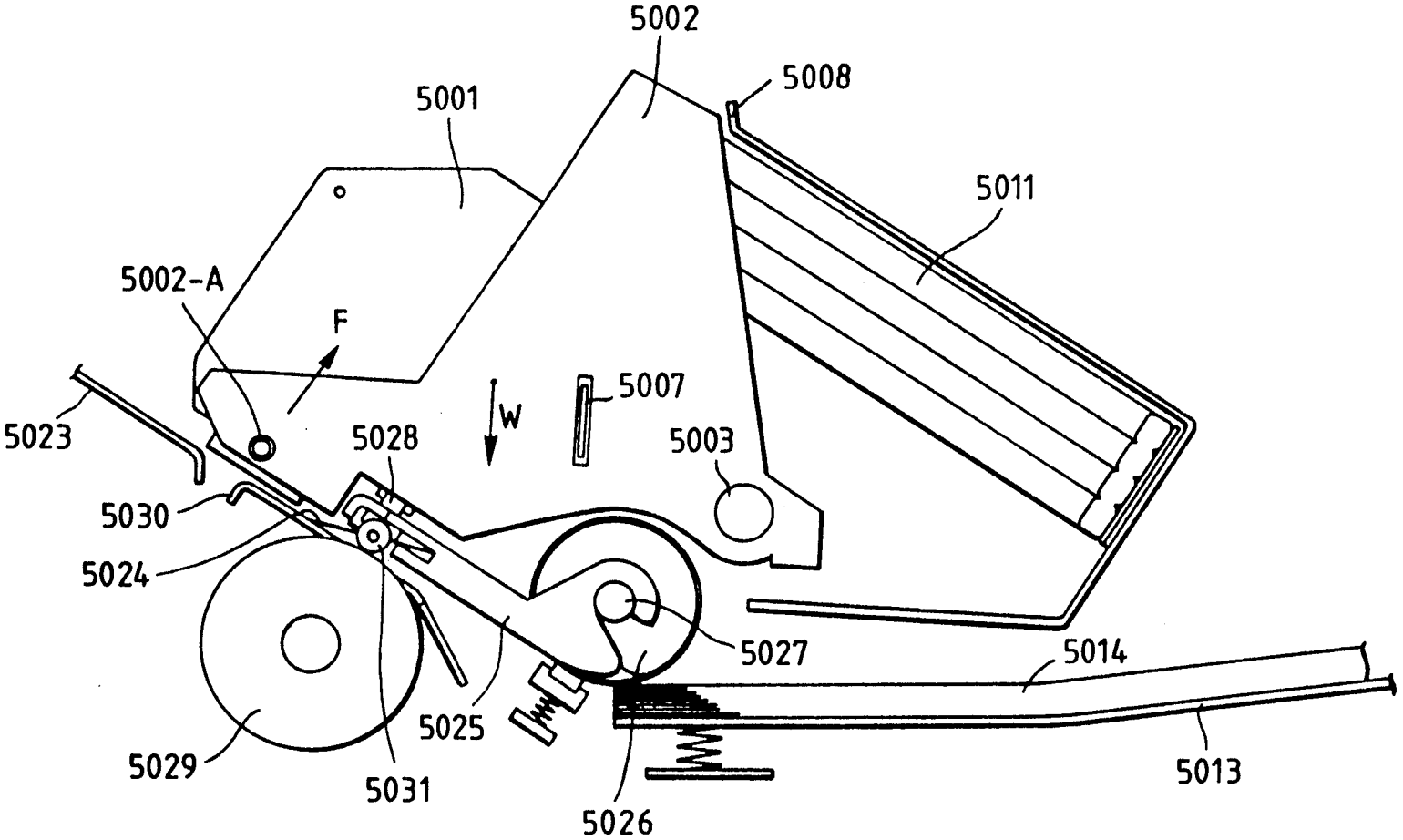
FIG. 30 is a lateral cross-sectional view thereof including a carriage part.

FIGS. 29 and 30 are respectively a perspective view of an ink jet printer of a fourth embodiment of the present invention and a lateral cross-sectional view thereof including a carriage.

Referring to FIG. 29, heads of four colors 5001-1, 5001-2, 5001-3, 5001-4 are mounted on a carriage 5002 serving as support means, which runs on a carriage shaft 5003 supported by a frame 5008. There are also provided a motor 5006, a belt 5004-1 fixed to the carriage 5002 and extended between pulleys 5005-1, 5005 2, and a belt 5004-2 extended between a pulley 5005-3 fixed on the motor shaft and the pulley 5005-2, whereby the carriage 5002 is moved by the belts 5004-2 and 5004-1 according to the rotation of the motor 5006. Interchangeable ink cartridges 5009, 5010 supply the heads 5001-1 to 5001-4 on the carriage 5002 with ink through flexible supply pipes 5011 and 5011'.

A recording medium 5014 such as recording paper or overhead projection film is loaded in a cassette 5012, transported to a recording position by paired transport rollers (not shown) which are positioned parallel to the carriage shaft 5003 and driven by a motor (not shown), and is discharged, after recording, to paired discharge rollers 5021, 5022 supported by a frame 5020. There is also provided a sheet tray 5013 for manual supply. FIG. 29 shows a state of sheet supply from the cassette 5012.

There are further shown an emission recovery unit 5015 containing caps 5016-1 to 5016-4 composed of flexible members and respectively engageable with the recording heads 5001-1 to 5001-4 and a suction pump (not shown), and a discharge pipe 5015-B provided between said suction pump and a joint to used ink reservoir provided in the ink cartridges 5009, 5010.

FIG. 30 shows a state in which recording media 5014 are stacked on the sheet tray 5013. A slider 5028 is provided on the carriage 5002 and slides along a guide plate 5025, while supporting a moment (in a direction W) acting on the carriage 5002 around the carriage shaft 5003.

There are further provided a sheet feeding roller 5026 for feeding the recording medium; a separating member 5038 maintained in contact with the sheet feeding roller 5026 by a spring and serving to separate the recording media 5014 one by one; a transport roller 5029 for transporting the recording medium 5014; guide plates 5023, 5030 for the recording medium 5014; and a pressure plate 5024 for pressing the recording medium 5014.

A guide plate 5025 is rotatably supported by the shaft 5027 of the feeding roller 5026, and is provided with a bearing for rotatably supporting a contact roller 5031, which is in contact with the transport roller 5029. Said rollers serve to transport the recording medium 5014, and, when the recording medium 5014 enters between said rollers, the guide plate 5025 rotates about the shaft 5027 according to the thickness of said recording medium, whereby the carriage 5002 rotates about the shaft 5003 by way of the slider 5028 contacting the guide plate 5025. Consequently the emission openings of the recording heads 5001 (heads 5001-1 to 5001-4 shown in FIG. 29 inclusive) are separated by a constant distance from the recording surface, regardless of the thickness of the recording medium 5014.

Referring to FIG. 29 or 30, a hole 5015-A provided in the recovery unit 5015 engages with a pin 5002-A of the carriage 5002 when the recording head 5001 or the carriage 5002 is placed at the capping position.

At the recording operation, the inks of the ink cartridges 5009, 5010 are supplied to the recording heads 5001-1 to 5001-4, and an emission energy generating member such as an electrothermal converting element provided in each emission opening is activated according to the recording data, whereby an ink droplet is emitted from the emission opening and deposited on the surface of the recording medium 014, thus forming a record dot. With the proceeding of the recording, the motor 5006 is rotated to displace the carriage 5002 in the main scanning direction. The position control in this operation can be achieved by detecting slits formed on a film 5007 with a sensor (not shown) mounted on the carriage 5002.

If emission failure occurs in the emission openings of the recording heads 5001-1 to 5001-4 due to ink clogging or dust deposition, the carriage 5002 moves to a recovery position in which the recording head 5001 is opposed to the emission recovery unit 5015. In this state the caps 5016-1 to 5016-4 are retracted in a direction C' in FIG. 29, so as not to hinder the movement of the carriage 5002. In said recovery position, the pin 5002-A of the carriage 5002 engages with the hole 5015-A of the recovery unit 5015. After the carriage is stopped at said recovery position, the caps 5016-1 to 5016-4 are moved in a direction C" to tightly cover the face of the recording heads 5001-1 to 5001 4 having the emission openings. The suction pump is activated in this state to suck the solidified impurities and dust together with the ink, and discharge the used ink through the tube 5015B to the used ink reservoir in the ink cartridges 5009 or 5010.

In this operation, the pressing force of the caps 5016-1 to 5016-4 functions in a direction F shown in FIG. 30, with respect to the recording heads 5001-1 to 5001-4 and the carriage 5002. However, since the carriage 5002 and the emission recovery unit 5015 mutually engage by the pin 5002-A and the hole 5015-A, said pressing force is supported by said engaging portion, so that the carriage 5002 does not escape.

Consequently, in the present embodiment, the recovery operation with secure closing can be achieved if sufficient rigidity is provided for the carriage 5002, recording heads 5001-1 to 5001-4, pin 5002-A and hole 5015-A and positional precision is secured in the engaging portion, without any improvement in the rigidity and precision of other components. Particularly the carriage shaft 5003 does not require any increased rigidity, as it is only subjected to a moment of rotation thereabout. Also the number of shafts can be reduced to one, as the carriage is guided by the slider 5028 according to the thickness of the sheet.

In the present embodiment, a pin and a hole are respectively formed on the carriage 5002 and the emission recovery unit 5015, but they may be mutually exchanged.

EMBODIMENT 5

Figure 31A:
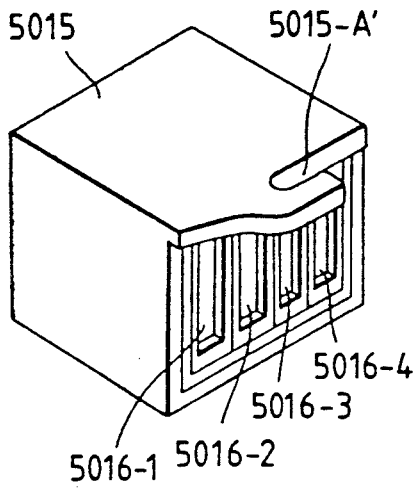
FIGS. 31 and 32 are perspective views of a principal part of still other embodiments of the present invention.
Figure 31B:
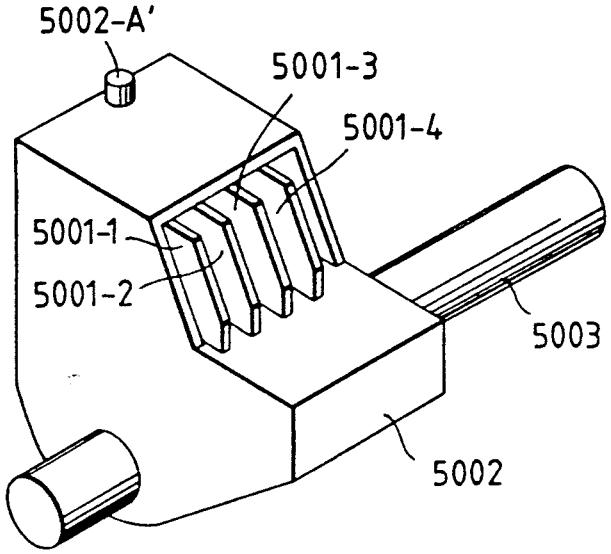

FIG. 31 shows a fifth embodiment of the present invention, modified in a part of the carriage 5002 and the recovery unit 5015 from the embodiment shown in FIG. 29, and FIG. 31 illustrates only the principal part. Also same or equivalent components as those in FIG. 29 are encoded in the same way, and will not be explained further.

In FIG. 31, the carriage 5002 is provided with a pin 5002-A' engageable with a U-shaped groove 5015A' of the recovery unit 5015.

The present embodiment can achieve same effect as explained above. In addition, in a structure involving plural recording heads 5001-1 to 5001-4 and a laterally wide caps 5016-1 5016-4, the closing action of the caps 5016-1 to 5016-4 can be achieved with satisfactory balance as the engaging portion can be positioned at the center.

EMBODIMENT 6

Figure 32A:
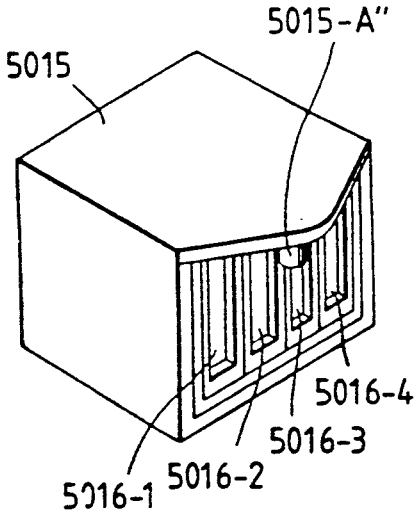
Figure 32B:
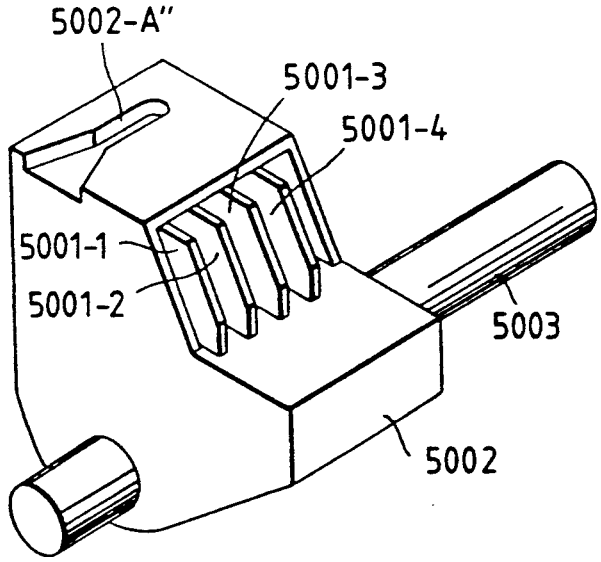

FIG. 32 shows a sixth embodiment of the present invention, modified in a part of the carriage 5002 and the recovery unit 5015 from the embodiment shown in FIG. 31, and FIG. 32 illustrates only the principal part. Also same or equivalent components as those in FIG. 31 are encoded in the same way, and will not be explained further.

In FIG. 32, the recovery unit 5015 is provided with a pin 5015-A", engageable with a U-shaped groove 5002-A" on the carriage 5002. The present embodiment can also provide same effect as in the embodiment shown in FIG. 31.

Four recording heads are employed in the foregoing embodiments, but the number of heads can naturally be selected in arbitrary manner.

It is also possible to employ plural engaging means, for example through the combination of embodiments 4 and 5 or 4 and 6, whereby the stability in the closed state can be improved as the cap 5016 is supported by plural engaging means. Such structure is advantageous in case of employing plural recording heads as explained above.

Also in the foregoing embodiments, disposable ink cartridges are provided separately from the recording heads, but they may be integrally mounted on the carriage.

It is furthermore possible to integrally form the recording heads and the carriage and to engage the recording head itself and the recovery unit, thereby supporting the pressing force.

Also in the foregoing embodiments, the caps are made movable front and back, but it is possible to move the recording heads with respect to the caps.

Furthermore, there may be provided a member for supporting the pressing force in excess of the force required for achieving the closed state with the caps, thereby reducing the rigidity of the head and the carriage.

Furthermore, the emission recovery process conducted in the closed state is not limited to the above-explained suction process, but may also be conducted by pressurizing of the ink supply system or by mere capping.

Furthermore, the members for preventing the rotation of the carriage 5002 in the capping operation (namely the pin 5002-A and hole 5015-A) can be subjected to certain modification. For example it is possible to provide the recovery unit 5015 with a pin retractable for example with a solenoid, and to provide the carriage 5002 with an engaging hole. Also the mechanical engagement may be replaced by magnetic engagement between an electromagnet and a magnetic material, or an electromagnet and a permanent magnet.

Also in the foregoing embodiments the recording heads or the carriage is movable corresponding to the thickness of the recording medium, but the present invention is likewise applicable to the apparatus lacking such mechanism.

Also in the foregoing embodiment there has been explained the application of the present invention to a serial recording apparatus in which the recording operation is conducted by moving the recording head in a predetermined direction with respect to the recording medium, but the present invention is effectively and easily applicable to an apparatus with a so-called full multi recording head having emission openings over the entire width of the recording medium, if there is employed a mechanism for moving said recording head to a capping position for the capping operation.

We claim:

1. A recording apparatus for effecting a recording operation by scanning a recording head, provided with discharge openings for discharging recording liquid, in a predetermined direction relative to a recording medium, the apparatus comprising:

a cap member capable of covering a face of said recording head having said discharge openings;

a transmission member having a mechanism for causing said cap member to cover said face of said recording head in relation to a setting motion of said recording head to a predetermined position;

recovery means for effecting a discharge recovery process by forcibly causing discharge of said recording liquid from said discharge openings at said predetermined position;

open/closing means for opening and closing a space defined by said cap member to the exterior when said face of said recording head has been covered by said cap member for a predetermined time; and control means for actuating drive means for scanning said recording head so that said recording head is stopped at said predetermined position, for interrupting actuation of said drive means after said opening/closing means has been opened and closed, and for resetting said recording head to said predetermined position prior to effecting said discharge recovery process after said opening/closing means has been opened and closed.

2. A recording apparatus according to claim 1, wherein said recovery means includes a suction pump which effects the discharge recovery process by sucking the recording liquid from said discharge openings when said face of said recording head is covered by said cap member.

3. A recording apparatus according to claim 1, wherein said recovery means effects the discharge recovery process by discharging the recording liquid forcibly from said discharge openings by pressuring the recording liquid in said recording head.

4. A recording head according to claim 1, wherein said mechanism of said transmission member includes a cam mechanism for allowing said cap member to slide.

5. An ink jet recording apparatus according to claim 1, wherein opening and closing of said opening/closing means is effected at a position other than an area in which said recording head is scanned for recording.

6. A recording apparatus according to claim 1, wherein said recording head is adapted to form an image by discharging the recording liquid from said discharge openings utilizing thermal energy.

7. A recording apparatus for effecting a recording operation by scanning a recording head, provided with discharge openings for discharging recording liquid, in a predetermined direction relative to a recording medium, the apparatus comprising:

setting means for setting said recording head at a first position outside a scanning area in which said recording head is scanned for recording an at a second position more distant from said scanning area than said first position;

a cap member capable of covering a face of said recording head having said discharge openings and having an externally communicating unit;

a transmission mechanism supporting said cap member and adapted to cause said cap member to cover said face of said recording head at least in a range from said first to said second position, in relation to the setting of said recording head to said first position from said scanning area;

pressure generating means for applying a negative pressure in a space defined by said face of said recording head and said cap member covering said face, or for applying pressure for introducing ink from an ink source into said space;

valve means for switching a liquid path either in a first direction for applying negative pressure in said space or in a second direction for applying pressure for ink introduction; and a closing member for closing said externally communicating unit of said cap member at said first position and moving with said recording head to said second position while maintaining said closed state, and for biasing a valve member of said valve means in a position for switching the liquid path to said second direction in response to the motion of said recording head to said second position.

8. An ink jet recording apparatus according to claim 7, wherein said transmission mechanism includes a cam mechanism for allowing said cap member to slide.

9. A recording apparatus according to claim 7, wherein said recording head is adapted to form an image by discharging the recording liquid from said discharge openings utilizing thermal energy.

10. A recording apparatus for effecting a recording operation by scanning a recording head, provided with discharge openings for discharging recording liquid, in a predetermined direction relative to a recording medium, the apparatus comprising:

a cap member capable of covering a face of said recording head having said discharge openings;

a transmission member for causing said cap member to cover said face of said recording head in relation to a setting motion of said recording head to a predetermined position; and engaging members including a protruding part provided on one of said recording head and a carriage supporting said recording head, and a receiving part for said protruding part formed on the other of said recording head and said carriage, wherein said protruding part and said receiving part mutually engage at two points when said cap member covers said face with discharge openings.

11. A recording apparatus according to claim 10, wherein said transmission member includes a cam mechanism for allowing said cap member to slide.

12. A recording apparatus according to claim 10, wherein said receiving part is a bore.

13. A recording apparatus according to claim 10, wherein said recording head is adapted to form an image by discharging the recording liquid from said discharge openings utilizing thermal energy.

14. A recording apparatus comprising:

a recording head with discharge openings for discharging recording liquid;

capping means comprising a cap member capable of being positioned opposite said recording head and adapted to move relative to said recording head in said opposed position thereby covering a face of said recording head having said discharge openings; and engaging means consisting of engaging parts respectively provided on said recording head, or support means supporting said recording head, and said capping means and adapted to mutually engage in said opposed state thereby prohibiting the movement of said recording head in the direction of said relative movement.

15. A recording apparatus according to claim 14, wherein said engaging means consists of a protruding part on one of said recording head or support means and said capping means, and a receiving part capable of engaging with said protruding part on the other.

16. A recording apparatus according to claim 15, wherein said receiving part is a bore.

17. A recording apparatus according to claim 14, wherein said recording head is adapted to form an image by discharging the recording liquid from said discharge openings utilizing thermal energy.

18. A recording apparatus comprising:

sheet feeding means for feeding a recording medium;

a motor for driving said sheet feeding means:

a clutch for transmitting the rotation of said motor to said sheet feeding means only in a first rotating direction;

an element utilizing the rotation of said motor as the driving power only in a second rotating direction opposite to said first rotating direction; and control means for rotating said motor in said first direction after a predetermined function of said element is performed by said motor.

19. A recording apparatus according to claim 18, comprising a liquid jet recording apparatus provided with a liquid jet recording head which performs recording by discharging the recording liquid from a discharge opening.

20. A recording apparatus according to claim 19, wherein said liquid jet recording head discharges the recording liquid utilizing thermal energy.

21. An ink jet recording head according to claim 19, wherein the predetermined operation of said element is a recovery operation to recover a discharge state of recording liquid from said discharge opening.

22. An ink jet recording apparatus according to claim 21, wherein the recovery operation includes a suction operation for sucking recording liquid from said discharge opening.

23. A recording apparatus for effecting a recording by scanning a recording head, provided with a discharge opening for discharging recording liquid, relative to a recording medium, the apparatus comprising:

a cap member capable of capping a discharge opening surface of said recording head and having a portion communicated with atmosphere; and suction means for sucking recording liquid from the discharge opening;

wherein said recording apparatus is operable in a large recovery mode in which recording liquid is introduced into said cap member, when said discharge forming surface is covered by said cap member and said portion communicated with atmosphere is closed, by discharging recording liquid into said cap member and by sucking recording liquid from said discharge opening with said suction means, and in a small recovery mode in which only suction of the recording liquid from said discharge opening is performed by said suction means when said discharge opening surface is covered by said cap member and said portion communicated with atmosphere is closed, the large recovery mode and small recovery mode being performed based on a set position of said recording head in a area other than a scanning area of the recording head for recording.

24. A recording apparatus according to claim 23, further having an idle discharge mode wherein the recording liquid is discharge form said discharge opening toward said cap member when said discharge opening surface is covered by said cap member and the portion communicated with atmosphere is opened.

25. A recording apparatus according to claim 23, wherein said recording head is adapted to form an image by discharging the recording liquid from said discharge opening utilizing thermal energy.

* * * * *

UNITED STATES PATENT AND TRADEMARK OFFICE

CERTIFICATE OF CORRECTION

PATENT NO. : 5,138,343 
DATED : August 11, 1992
INVENTOR(S) : Takao Aichi, et al It is certified that error appears in the above-indentified patent and that said Letters Patent is hereby corrected as shown below:

COLUMN 1

Line 62, "start" should read --state--.

COLUMN 2

Line 46, "sucking" should read --sucks--.
Line 47, "eliminating" should read --eliminates--.

COLUMN 3

Line 20, "reduces" should read --reduce--.

COLUMN 4

Line 48, "openings" should read
--the discharge openings--.

COLUMN 5

Line 47, "provide" should read --provides--.

COLUMN 6

Line 58, "mean" should read --means--.

COLUMN 7

Line 47, "points For" should read --points. For--.

UNITED STATES PATENT AND TRADEMARK OFFICE

CERTIFICATE OF CORRECTION

PATENT NO. : 5,138,343

DATED : August 11, 1992

INVENTOR(S) : Takao Aichi, et al

It is certified that error appears in the above-indentified patent and that said Letters Patent is hereby corrected as shown below:

COLUMN 8

Line 56, "a enlarged" should read --an enlarged--.
Line 68, "part,;" should read --part;--.

COLUMN 10

Line 63 "or" should read --paper dust or--.

COLUMN 12

Line 14, "activate" should read --activated by the--.
Line 59, "head" should read --head 2001--.

COLUMN 14

Line 10, "including" should read --inducing--.

COLUMN 15

Line 5, "enough" should read --sufficient--.
Line 26, "rotating" should read --rotates--.
Line 47, "3007a" should read --3007b--.

COLUMN 16

Line 47, "aid" should read --air--.

UNITED STATES PATENT AND TRADEMARK OFFICE

CERTIFICATE OF CORRECTION

PATENT NO. : 5,138,343

DATED : August 11, 1992

INVENTOR(S) : Takao Aichi, et al

It is certified that error appears in the above-indentified patent and that said Letters Patent is hereby corrected as shown below:

COLUMN 17

Line 13, "or" should read --of--.
Line 43, "slop" should read --slope--.

COLUMN 18

Line 7, "3041 Thus" should read --3041. Thus--.
Line 27, "state Consequently" should read --state. Consequently--.

COLUMN 19

Line 18, "a pins" should read --pins--.
Line 64, "state ⑤)." should read --state ⑤.--.

COLUMN 20

Line 4, "state ⑤," should read --state ⑤--.
Line 8, "then" should read --Then--.
Line 17, "(2X360°83°)," should read --(2X360°+83°),--.
Line 49, "at" (first occurrence) should be deleted.

COLUMN 21

Line 14, "are" should be deleted.
Line 44, "for" (second occurrence) should be deleted.
Line 54, "rollers 4652 provided on" should be deleted.
Line 55, "both sides of the separating" should be deleted.

UNITED STATES PATENT AND TRADEMARK OFFICE

CERTIFICATE OF CORRECTION

PATENT NO. : 5,138,343

DATED : August 11, 1992

INVENTOR(S) : Takao Aichi, et al

It is certified that error appears in the above-indentified patent and that said Letters Patent is hereby corrected as shown below:

COLUMN 22

Line 14, "pag" should read --pad--.
Line 26, "angle o" should read --angle α--.

COLUMN 23

Line 31, "16" should read --4016--.

COLUMN 27

Line 17, "51;" should read --4051;--.
Line 24, "1141" should read --1411--.

COLUMN 28

Line 26, "5005 2," should read --5005-2,--.

COLUMN 29

Line 22, "014," should read --5014,--.
Line 41, "5001 4" should read --5001-4--.

COLUMN 30

Line 17, "a" should be deleted.
Line 18, "caps 5016-1 5016-4," should read --caps 5016-1 to 5016-4,--.

UNITED STATES PATENT AND TRADEMARK OFFICE

CERTIFICATE OF CORRECTION

PATENT NO. : 5,138,343

DATED : August 11, 1992

INVENTOR(S) : Takao Aichi, et al

It is certified that error appears in the above-indentified patent and that said Letters Patent is hereby corrected as shown below:

COLUMN 31

Line 41, "open/closing means" should read --opening/closing means--.

COLUMN 32

Line 16, "an" should read --and--.

COLUMN 34

Line 39, "a" (second occurrence) should read --an--.
Line 44, "discharge form" should read --discharged from--.

Signed and Sealed this

Twelfth Day of October, 1993

*Attest:*

*Attesting Officer*

BRUCE LEHMAN

*Commissioner of Patents and Trademarks*